US007743692B2

(12) United States Patent
Jackson

(10) Patent No.: US 7,743,692 B2
(45) Date of Patent: Jun. 29, 2010

(54) SHELL CASE LENGTH LIMIT ALARM

(76) Inventor: Jason S. Jackson, 11242 Gallahadion Ct., Parker, CO (US) 80138

( * ) Notice: Subject to any disclaimer, the term of this patent is extended or adjusted under 35 U.S.C. 154(b) by 351 days.

(21) Appl. No.: 11/968,649

(22) Filed: Jan. 2, 2008

(65) Prior Publication Data

US 2010/0122624 A1 May 20, 2010

(51) Int. Cl.
*F42B 33/00* (2006.01)

(52) U.S. Cl. ..... 86/23

(58) Field of Classification Search ..... 86/23, 86/25, 28, 36, 1.1
See application file for complete search history.

(56) References Cited

U.S. PATENT DOCUMENTS

| | | | | | |
|---|---|---|---|---|---|
| 659,724 | A | * | 10/1900 | Wills | 86/23 |
| 2,224,204 | A | * | 12/1940 | Wassen | 86/23 |
| 3,483,792 | A | | 12/1969 | Williams | |
| 4,127,054 | A | * | 11/1978 | Gully | 86/23 |
| 4,163,410 | A | | 8/1979 | Dillon | |
| 4,343,222 | A | | 8/1982 | Dillon | |
| 4,522,102 | A | | 6/1985 | Pickens | |
| 4,620,472 | A | | 11/1986 | Dillon | |
| 4,766,798 | A | | 8/1988 | David et al. | |
| 4,813,827 | A | | 3/1989 | Dugger | |
| 4,852,451 | A | * | 8/1989 | Rogers | 86/23 |
| 4,918,825 | A | * | 4/1990 | Lesh et al. | 33/506 |
| 4,984,501 | A | * | 1/1991 | Roller | 86/23 |
| 5,309,813 | A | | 5/1994 | Henley | |
| 5,570,513 | A | | 11/1996 | Peterson | |
| 5,635,661 | A | | 6/1997 | Tuftee | |
| 6,101,915 | A | | 8/2000 | Sinclair | |
| 6,397,720 | B1 | * | 6/2002 | Fox et al. | 86/23 |

* cited by examiner

*Primary Examiner*—Michael Carone
*Assistant Examiner*—Jonathan C Weber
(74) *Attorney, Agent, or Firm*—Kyle W. Rost

(57) ABSTRACT

A reloading machine is configured to check the length of shell cases of selected caliber against a length specification for the caliber. A shell case entering a workstation tool strikes a sleeve by end-to-end contact, raising the sleeve in direct proportion to any excess length of the shell case. A detector monitors how high the sleeve is raised and triggers a signal if the height indicates the shell case is too long. Length detection is derived from a powder measure assembly by monitoring the raised height of the powder body. Length detection is derived from a powder level check assembly by introducing an intermediate sleeve between the powder check die and check rod assembly. The intermediate sleeve is sized to engage a shell case of the selected caliber, at least when the shell case exceeds the specified length. The raised height of the intermediate sleeve allows determination of case length or identification of shell cases of excess length.

14 Claims, 11 Drawing Sheets

SHELL CASE LENGTH LIMIT ALARM

BACKGROUND OF THE INVENTION

1. Field of the Invention

The invention generally relates to ammunition making. More specifically, the invention relates to firearm cartridge casings and to finishing operations. Especially in the practice of single stage or progressive ammunition loading and reloading, an improved implement checks the length of a case while conducting another step such as filling, resizing, or reconditioning.

2. Description of Related Art Including Information Disclosed Under 37 CFR 1.97 and 1.98

Spent firearm cartridge casings, referred to as cases or brass, often can be reused by reloading. The reloading process involves a series of basic steps, including sizing the case, decapping, priming, powder charging, and seating a new bullet. Some of these steps can be combined or separated into several sub-steps. Additional steps can be performed and may be required with specialized types of cases. These steps and variations of them can be performed either by hand or by machine. A single stage or multistage mechanical press, sometimes called a reloading press, is a useful aid to performing these steps.

A multistage press, such as a progressive, multi-station reloading machine can perform the required steps by incrementally processing a case through an indexed series of workstations. A different die or tool is located at each workstation and performs a processing step on a case when the case is present at the workstation. Commonly, the workstations are arranged in a circle on a tool platform. Such a reloading machine employs a turret or rotary conveyor to carry a series of cases from workstation to workstation.

The rotary conveyor or shell plate defines a plurality of conveyor stations, each adapted to carry a case. The conveyor stations are spaced apart similarly to the workstations, so that the shell plate can be stopped at index points at which each workstation is aligned with a conveyor station. With a case carried in a conveyor station, the shell plate rotates in a parallel circle on a common axis to the workstation circle. When stopped at the index points, the shell plate can be elevated toward the tool platform, thereby raising the carried case toward the die at the workstation to engage the case in the die. Subsequently, the shell plate lowers to remove the case from the die.

The dies or other tools are carried on the tool platform or tool head in a circular array. Commonly, the tool platform provides a threaded bore at each workstation. A die or other tool is installed at a workstation by threading it into the appropriate threaded bore. Each die is adjusted to process a size or length of case by adjusting how deeply the die is threaded into the tool platform. In some instances, the workstation where a die or tool might be installed is chosen from several candidates, while other dies or tools must be installed at a specific workstation or in a specific sequence.

The tools installed at the various workstations perform the required functions in various combinations and with additions or modifications accounting for the different numbers of stations. For example, the reloading machine shown in U.S. Pat. No. 4,163,410 to Dillon provides eight stations. Seven of these stations have distinct functions, which are: inserting the shell into the machine, sizing the case and decapping to remove the spent primer, swaging the primer cavity, seating a new primer, belling the case and loading a powder charge, seating a new bullet, and removing the reloaded shell from the machine. This patent also discloses a powder dispenser that operates by causing a powder bar to slide in response to elevation of a shell case into the powder charging workstation.

Processing steps such as inserting and removing the case from the rotary conveyor may be performed manually or may employ inserting or removing mechanisms operating from a position other than the tool head, such as from a side of the case or the side of the rotary conveyor. Inserting and removing a case from the conveyor may take place other than at an index point.

The reloading machine shown in U.S. Pat. No. 4,343,222 to Dillon provides four stations. The first station combines inserting a spent shell into the machine, sizing the shell in a sizing die, decapping with a decapping pin, and seating a new primer. The second station loads a powder charge into the shell. The third station seats a bullet into the shell. The fourth station crimps the shell. The completed shell then advances to the first station for a second time, where it is removed from the machine before another spent shell replaces it on the rotary conveyor. This reloading machine employs a swinging toggle linkage for elevating the rotary conveyor or turret that carries shells between workstations.

Reloading machines with five stations are sold commercially. The technology of operation is similar to that described in the aforementioned patents to Dillon. The functions of the five stations can be: sizing, decapping and priming; powder charging; powder checking; seating a new bullet; and crimping. Inserting and removing the cases is automated and takes place at separate positions, before the first and after the last workstations.

In a progressive reloading machine that employs a tool head with dies or tools carried in a circular pattern, the tool head often is mounted at the top of a frame. The rotary conveyor or shell plate that carries the cases is mounted to the frame below the tool head, on a concentric axis to the circle of tool head bores. The shell plate carries cases with their open end facing up, toward the tool head. The shell plate clips to the base of each case so that the shell plate can both push and pull the cases without separating from the cases.

Some progressive reloading machines operate similarly to a manually operated press. A manually operated lever and crank mechanism elevates the rotary conveyor and all carried shell cases toward the tool head, such that the cases longitudinally engage the dies or tools at the various workstations of the tool head. This longitudinal engagement of cases and dies causes the dies to perform their corresponding functions on the respective engaged cases. Thus, a step of the reloading process takes place at each of the workstations, as respective cases are decapped, primed, charged with powder, and seated with a bullet.

The lever and crank mechanism then is moved in reverse direction to lower the rotary conveyor and its carried cases and to cause the shell plate to advance to the next index position. Thereafter, the sequence is repeated as necessary to process each shell case at each workstation. A lever and crank mechanism for a reloading machine is known from U.S. Pat. No. 4,522,102 to Pickens.

While elevating the conveyor is the common practice, equivalently the tool head could be lowered toward the conveyor to engage the shell cases in the dies or tools at the respective workstations and to thereby perform the respective reloading steps. In such a reversed operation, the tool head must be raised to disengage from the shell cases before the rotary conveyor advances to the next index point.

U.S. Pat. No. 3,483,792 to Williams shows a progressive reloading machine that lowers the tool head instead of raising the turret. In addition, the Williams patent shows six work stations, where the reloading tasks are divided into loading the shell case into the turret, depriming, belling the case mouth and inserting a new primer, loading a powder charge, seating a bullet, and removing the shell from the turret.

Because reloading typically is practiced on used shell cases, initially the cases are deformed such that they do not meet size specifications. Not all cases can be reused. Even after a single firing, some cases are ruined beyond reclamation.

The problem of reforming a spent cartridge case during reloading is partially met by use of a sizing die. Often the first step in reloading is to insert a case longitudinally into a sizing die. Often the sizing die is combined with a decapping pin. Thus, in a progressive or multi-station press, the first workstation after a case is loaded into the shell plate should carry the sizing die. The sizing die will reform the case both from the outside and from the inside. A cavity in the die is suitably shaped to reform the exterior profile of a case to specifications, at least as to maximum sidewall diameter and diametric contour. An expander ball carried on the centerline of the die cavity enters the case mouth to expand the mouth to specified size. Subsequently, when the shell plate is lowered, the case is pulled free of the cavity and of the expander ball. U.S. Pat. No. 5,635,661 to Tuftee shows such a sizing die with internal expander ball.

A sizing die is not always able to restore a case to specified length. If a case is too short, typically it cannot be reused because there is no economical way to lengthen such a case. A case that initially is too long possibly can be restored to specified length. However, the stroke of a reloading machine is fixed or at least is poorly adapted for adjustment to the sizing requirements of each individual spent case.

Machines for trimming long cases independently of a reloading press are known, as shown in U.S. Pat. No. 6,101,915 to Sinclair and U.S. Pat. No. 4,813,827 to Dugger. These trimmers are not suited for use in a progressive reloading machine. However, U.S. Pat. No. 5,309,813 to Henley proposes a power operated resizing die combined with a case length trimmer, in a form factor adapted for use with a progressive reloading machine.

A sizing die offers length adjustment to coordinate with the stroke of the reloading machine. Such adjustment typically is a batch adjustment that takes into account the maximum length specification for the size of cartridge case being reloaded. The depth of the sizing die in the threaded bore of the tool platform can be set by trial and error, by processing sample cases from the batch and then measuring the resulting cases after they are removed from the reloading press. Measurement tools typically are independent of a reloading press. United States patents that disclose an independent case length measurement tool include: U.S. Pat. No. 4,918,825 to Lesh and U.S. Pat. No. 5,570,513 to Peterson. Some sizing dies offer length gradations on a threaded adjuster to reduce the amount of trial and error. U.S. Pat. No. 6,397,720 to Fox et al shows a sizing die with measurement markings on an adjuster.

Sizing dies inherently introduce error into the determination and adjustment of case length. Substantially every known sizing die suited for use with a reloading machine relies upon longitudinal withdrawal of the case from the die. Even a sizing die with built-in trimmer, such as taught in the Henley patent, suffers the introduction of inaccuracy when the sized and trimmed case is longitudinally withdrawn from the die. Friction from the die on the external surface of the case, and friction from the expander ball on the internal surface of the case, can lengthen the case by an unknown and unpredictable amount.

Shell cases are lubricated prior to processing in a reloading machine. Lubricant properties differ. The use of different lubricants might result in variations of length as cases are sized.

Even new brass cases vary in configuration, which would be expected in a mass produced product. After a cartridge has been fired, the residual configuration and characteristics of a spent brass case will be still more unique and individual. The frictional interaction between any one spent case and a sizing die can be uniquely different than with a different spent case. For these reasons, the practice of adjusting headspace in a sizing die by using a few test cartridge cases does not necessarily produce an accurate result with any other cartridge case.

Pistol ammunition encounters another source of error during reloading. The case mouth must be belled before the new bullet is seated. The belling step can be performed at any station before the new bullet is applied and seated. Some reloading machines perform the belling step in combination with recharging the case with powder. At a single workstation, the case is elevated against a powder funnel, where the case then raises the powder funnel, triggering the release of a powder charge that drops into the case. For pistol ammunition, the contact end of the powder funnel is configured to bell the case mouth. The rising case raises the powder funnel until the powder funnel strikes a stop. The case rises further, belling the case mouth against the stopped powder funnel. The belled and recharged case then is lowered from the powder funnel. The belling step introduces another opportunity for the case length to change in an unpredictable manner.

The practice of reloading cartridge cases often is motivated by reasons of economy. Clearly it would desirable to identify defectively sized cases as early as possible in the reloading process, before investing needless materials in a cartridge that cannot be used. A key stage in reloading is the seating of the new bullet. When the bullet has been seated, the bullet and powder charge no longer can be safely salvaged from the cartridge. Thus, the cost of the reloaded cartridge has been fully committed. Removing a bullet from a live cartridge is dangerous. Despite the danger, people have tried to disassemble and salvage a fully reloaded cartridge. If for no reason other than to reduce this type of salvage effort, it would be desirable to identify defectively sized cartridges before the bullet is seated.

Cases that are longer than a specified limit are unsafe to use. A reloading machine will push such an overly long case too far forward onto the powder funnel or other belling device. As a product of the excess movement, the brass becomes crimped at the open end. The crimped brass might dig into the bullet and restrict the bullet from clean separation when fired. As a result, the case might fail, presenting a danger to the shooter and possibly damaging the firearm.

A progressive reloading machine offers the advantages of automation to the task of reloading a large number of cartridges. It remains possible to measure every case before seating the bullet by using an independent measuring tool such as those disclosed in the Lesh and Peterson patents. However, use of these tools would require that the case be removed from the progressive reloading machine before performing the bullet-seating step. This interruption of the progressive reloading cycle would defeat the purpose of having such a machine. Therefore, it would be desirable to identify a case having improper length both while the case remains in the progressive reloading machine and before the bullet-seating step.

A single-station reloading machine can perform the same steps as a progressive reloading machine, but done one tool or one step at a time. A first tool might be used to process an entire collection of cases, after which a second tool replaces the first and processes the entire collection of cases, and so on. A significant difference is that only one workstation is present on the single-station tool platform. Of course, the single-station reloading machine does not benefit from an indexing rotary conveyor system that moves the cases from workstation to workstation, as in a progressive reloading machine. Even a single-station reloading machine would benefit by a reduction in the number of tool changes by the combination of several functions into one tool or one step. For example, it would be beneficial to combine case length checking with another function, such as powder loading or powder level checking. Therefore, from the perspective of a single-station reloading machine, it would be desirable to combine case length checking with another function to be performed at one time.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a shell case length checking function at a workstation of pre-existing other function in a reloading machine. In the instance of a progressive reloading machine, the case length checking function is ordered after any prior steps or workstations that tend to alter the shell case length and before the step or workstation that seats a bullet in the shell case.

According to the invention, a reloading machine that has been setup to reload a shell case of a preselected caliber and is adapted to check the length of such shell case against a length specification for the preselected caliber while the shell case is being processed at a workstation that is performing another function of the reloading process, located after those workstations tending to alter the shell case length and before the workstation that seats a bullet in the shell case. A tool platform defines the workstation where the case length is checked. A workstation tool is connected to the tool platform at this workstation. The tool is composed of first and second tool subassemblies. The first tool subassembly is stationary in height with respect to the tool platform during reloading operation, defines a substantially vertical bore sized to axially receive a shell case of the preselected caliber with sidewall clearance, and carries the second tool subassembly for axial movement in the bore between repose height and elevated height. The second tool subassembly is sized to abut the leading end of a shell case of the preselected caliber entering the bore. A shell platform is spaced below the tool platform, is moveable between maximum and minimum relative separation from the tool platform, and carries a shell case of the preselected caliber with open end facing the tool and axially aligned with the bore. A drive mechanism is operably connected with respect to the shell platform and tool platform to selectively change the relative separation from maximum to minimum. The minimum separation of the shell platform is sufficiently close to repose height of the second tool subassembly that a shell case of the preselected caliber with length exceeding specification elevates the second tool subassembly by a distance indicative of the length of the shell case. A detection device is arranged to sense an elevated height limit of the second tool subassembly and to trigger an output signal in response. An alarm is connected to the detection device to receive the output signal and to produce an alarm signal in response to the output signal. An adjustment device is operatively connected to the detection device to adjust the elevated height limit, whereby the detection device triggers an alarm when a shell case of length exceeding specification elevates the second tool subassembly.

According to another aspect of the invention, a reloading machine is configured to reload shell cases of a preselected caliber and to check the length of a shell case of the preselected caliber against a length specification for the preselected caliber. The reloading machine includes a tool platform with a housing connected to the tool platform. The housing defines a substantially vertical bore having an open lower end. The vertical bore is arranged to receive a shell case from below the tool platform. The vertical bore is sized to axially receive a shell case of the preselected caliber with sidewall clearance so that the housing does not change the length of the shell case during relative axial movement in the bore.

A sleeve is slidably mounted in the vertical bore for axial movement between a repose height and an elevated height with respect to the tool platform. The sleeve is sized to abut a top end of a shell case of the preselected caliber axially entering the vertical bore with open end leading, such that the shell case will be able to axially elevate the sleeve with respect to the tool platform. An elevator platform is positioned below the tool platform and carries a shell case of the preselected caliber with its open end facing the lower end of the sleeve, positioned such that the shell case is in axial alignment with the sleeve. The elevator platform is movable between a relatively more distant position to a nearer position of a predetermined distance from the tool platform. The predetermined nearer position is such that a shell case of a length exceeding the specification will elevate the sleeve at least by the amount of the excess length. A detection device is arranged to sense the elevation of the sleeve and to send an output signal in response to sensing a predetermined elevation. An alarm is connected to the detection device to receive the output signal and to produce an alarm signal in response to the output signal.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
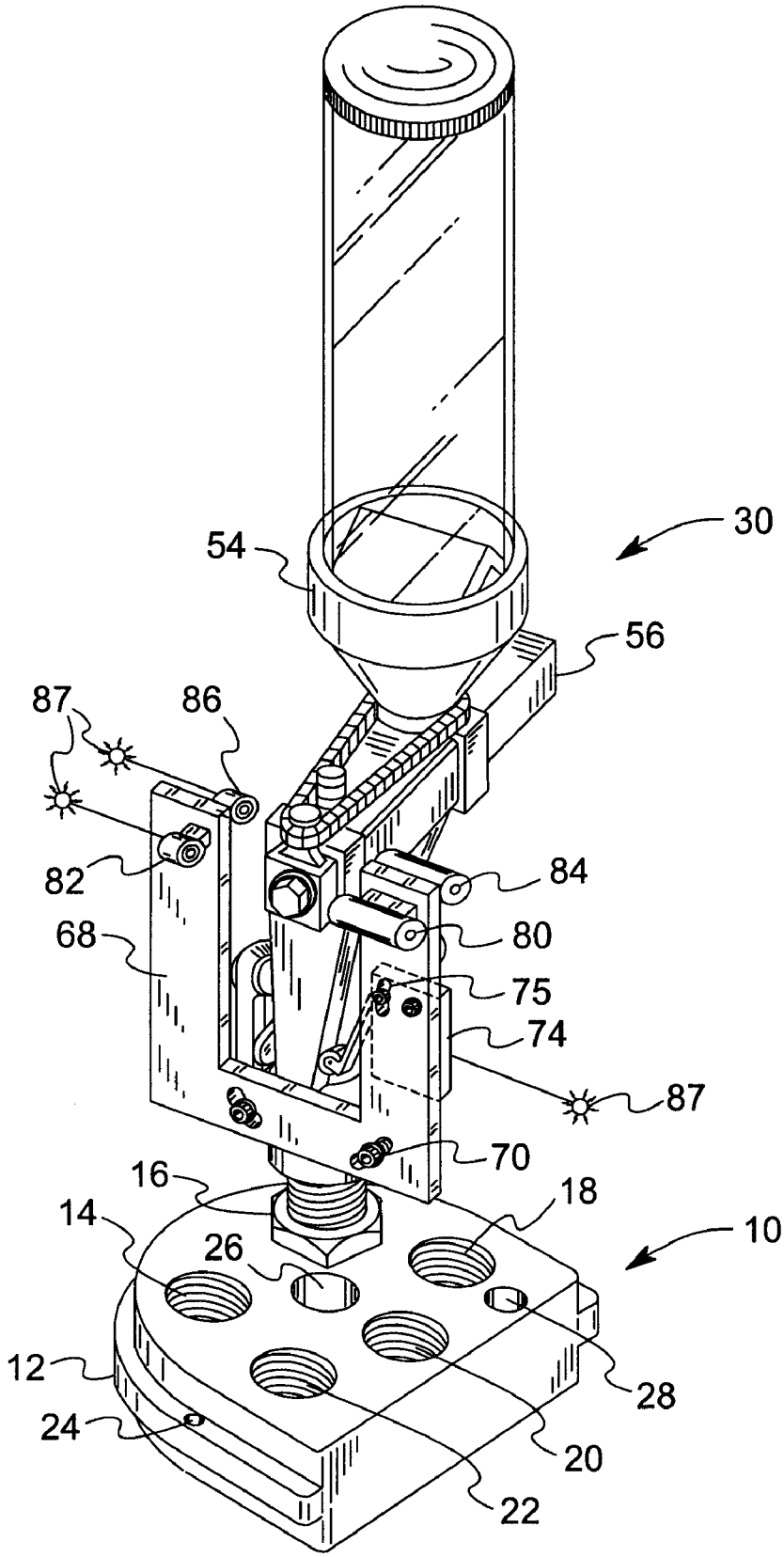
FIG. 1 is an isometric view of a portion of a progressive reloading machine showing a tool head with five workstations and a front left view of a powder measure assembly installed at workstation position two, and schematically showing a plurality of case length alarm devices installed on the powder measure assembly.

The invention is an apparatus and method for checking the length of a cartridge case while the case is being processed in a reloading machine and while the case remains inserted in the reloading machine. Both progressive and single-station reloading machines can benefit from the invention. In addition, the method and apparatus check the length of each case length after completion of steps likely to increase the case length beyond specification and before a bullet-seating step. The length determination function is combined with another reloading function of the single-station or progressive reloading machine. Therefore, the invention can be applied to existing single-station or progressive reloading machines without reducing the functionality of the machine and without requiring the introduction of a new workstation, in the case of a progressive reloading machine, or an additional single step, in the case of a single-station reloading machine. The best embodiments of the invention are applied to a powder drop workstation or a powder level checking workstation.

Progressive reloading machines commonly divide the reloading process among a small number of workstations. The invention can be applied to a reloading machine employing any number of workstations. As an example, for purposes of description and not limitation, the five-station reloading machine is suitable for performing a length-checking step without requiring an extra workstation, and in some situations, a four-station reloading machine is similarly suitable. The four or five workstations can be viewed as overhead workstations. The tool at each workstation has an open bottom for receiving the open top of a shell case. The cartridge cases are carried on a conveyor below the tools, open end up. The conveyor moves a case into vertical alignment with a workstation position. The tool and aligned case are moved longitudinally together, such that the open end of the case and the tool engage one another and thereby perform a step in the reloading process. Then the tool and aligned case are longitudinally separated. The conveyor may further advance the case to a next workstation.

Steps such as inserting or removing a cartridge case from a conveyor generally take place laterally to the conveyor and to the cartridge case. As such, those steps do not define a workstation as would be counted in describing a five-station reloading machine. Similarly, a step such as inserting a new primer takes place from the base or closed end of a cartridge case. Typically, a primer feed disk or slide operates below the shell plate and feeds a primer into an aligned position with a primer cavity in the base of the case. As the base of the case and the primer punch are moved toward one another, the primer rests on a primer punch, which pushes the primer into the primer cavity. This step may take place at any workstation prior to the step of adding a powder charge to the case. As an example, a case may be primed in alignment with the first workstation, as the shell plate is lowered toward the primer punch after having been raised into a sizing die to first decap the case. The priming system is not considered to be a separate workstation as would be separately counted in describing the operation of a five-station reloading machine.

The invention is best described and illustrated as having two alternative best modes. FIGS. 1-4 illustrate the application of the invention to a powder drop tool. Often, this tool is located at the second workstation of a progressive reloading machine. FIGS. 5-9 illustrate the application of the invention to a powder level checking system. Often, the powder level checking system is located at the third workstation of a progressive reloading machine. Each of these systems has a separate, established function in the reloading art. In accordance with the invention, each system is modified from standard configuration to recognize when a cartridge case of improper length is being processed. This determination is made while the tool is performing its prior known processing step in the progressive reloading machine. Particularly, each system is shown in an embodiment that identifies a cartridge case that is longer than specification.

A progressive reloading machine employs certain fixed dimensions and fixed geometrical relationships that enable the invention to check case lengths with reliability. The machine employs a frame to carry all other parts. A tool platform is a top level of the frame and establishes a first or top reference point for other machine movements. Various workstation tools mount to the tool platform. A vertically movable shell platform is located below the tool platform. The shell platform carries an indexing conveyor or shell plate, which carries the shell cases in clipped engagement at conveyor stations. The shell plate rotates to move the conveyor stations from one indexed location to another. The conveyor stations carry the shell cases with open end up, facing the tools. At the indexed locations, the shell plate stops with conveyor stations aligned with workstations. A shell case in a conveyor station at an indexed location is vertically aligned with a workstation tool.

In a typical embodiment, the shell platform can be elevated with respect to the frame over a stroke of fixed length, bringing the shell platform to a minimum separation from the tool platform. The top of the stroke, the position of the shell platform establishes a second reference point of predefined closeness to the tool platform, but still below the tool platform. The second reference point is high enough to bring the elevated shell cases into the tools by an appropriate amount for the tools to perform their respective reloading functions. The shell platform also lowers with respect to the frame through a reverse or downward stroke to a maximum distance from the tool platform, pulling the shell cases out of the tools.

A progressive reloading machine operates with a standard or fixed length longitudinal stroke of the shell platform, sufficient on upstroke to bring a shell case longitudinally into a reloading tool or workstation die. The reloading machine accommodates the degree of engagement required by each tool and variations among specified case lengths, such as for different caliber shells, by allowing the height of each tool to be adjusted individually on the tool platform. This adjustment is made by threading the tool into or out of the tool platform to achieve a proper degree of engagement with a shell case carried on the elevated shell platform at minimum separation from the tool platform. Each type of tool or die typically has a single correct height for a specific shell length or caliber. Also, according to well-known rules for selection, differently sized and configured workstation dies and related components are selected for use with different lengths or calibers of shell cases.

When suitable dies and related components are installed in the workstations of a progressive reloading machine, the machine is set up to accommodate a preselected caliber or length of case. The invention relies upon a proper set-up of the machine to process the preselected caliber or length of case so that the invention can identify cases of improper length. Likewise, the invention relies upon the selection and installation of suitable tools and dies for the preselected length and caliber of shell cases to be reloaded.

A properly sized and adjusted tool at a powder-charging station or a powder check station will receive shell cases that have at least proper diameter. Such cases may have been sized at a preceding sizing station or in a preceding step, or the cases might be new and therefore are of proper diameter. Such shell cases of the selected caliber can freely enter and exit the powder charging or powder check tools. The entry end of the tool is of sufficient size or lateral clearance with respect to the case sidewall that the case's entering or exiting the tool does not substantially alter case length.

INCORPORATION BY REFERENCE

The following United States patents are incorporated by reference herein: U.S. Pat. No. 4,163,410 to Dillon; U.S. Pat. No. 4,343,222 to Dillon; U.S. Pat. No. 4,620,472 to Dillon; and U.S. Pat. No. 4,522,102 to Pickens. Each discloses construction and operation of a progressive reloading machine to further enable a background understanding of the present invention.

FIGS. 1-4 disclose the first embodiment of a length limit detector that is incorporated into a progressive reloading machine. A description of how a progressive reloading machine functions will provide useful background for understanding the invention. A progressive reloading machine provides a tool platform such as tool head 10 that carries associated workstation tools. The tool platform also establishes a first plane of operation at which the tools are located in the reloading machine. The particular tool head 10 illustrated in FIG. 1 is a component tool head, which is insertable and removable from a larger tool platform that is a part of the machine frame, as described in the prior art that has been incorporated by reference. A peripheral rib 12 on the tool head 10 fits a complementary groove of the larger tool platform to support the tool head 10 at a fixed position and at the height of the first plane of operation with respect to the typical machine frame. A removable tool head 10 is commonly used for convenience in handling the various dies that it carries. For purposes of the present invention, the tool head 10 is representative of a tool platform that is a part of the machine frame. The tool platform carries various dies at corresponding workstations.

The tool head 10 establishes the locations of workstations of the progressive reloading machine by the positions of threaded bores, each suited to receive a workstation die or other workstation tool. The threaded bores are arranged in a circle, which enables the reloading machine to operate by shifting shell cases through a series of indexed locations following a circular path about a central axis.

The first threaded bore 14 defines the first workstation. According to the typical mechanisms of a reloading machine, the position of the first workstation is suitable for carrying a sizing die and decapping pin. Thus, during the progressive reloading process, a shell case is sized in diameter in a die at the position of the first bore 14. Then the shell case is advanced to the position of a second bore 16, which FIG. 1 shows to have a powder measure assembly 30 mounted to it. A third bore 18 establishes a workstation suited to receive a powder check station. A fourth bore 20 is suited to establish a bullet seating workstation. A fifth bore 22 is suited to establish a crimping workstation.

Additional bores in tool head 10 are complementary to the functions of the tool head and workstations. A bore 24 through rib 12 allows the tool head 10 to be latched into a larger tool platform by a through pin. A central bore 26 is formed on the center point of the circle of bores 14-22 and can serve as a centering guide for a rotary shell plate mechanism that advances the shell cases around the circle of indexed conveyor stations. The central bore 26 is smooth, such that it can receive and slide along a guide shaft to maintain alignment with the shell platform and guide the shell platform as it raises and lowers with respect to the tool head 10. A smooth bore 28 near the third workstation bore 18 is suited to receive a power measure rod, which is a component of the powder level checking assembly suited to be mounted at the third bore 18.

Figure 2:
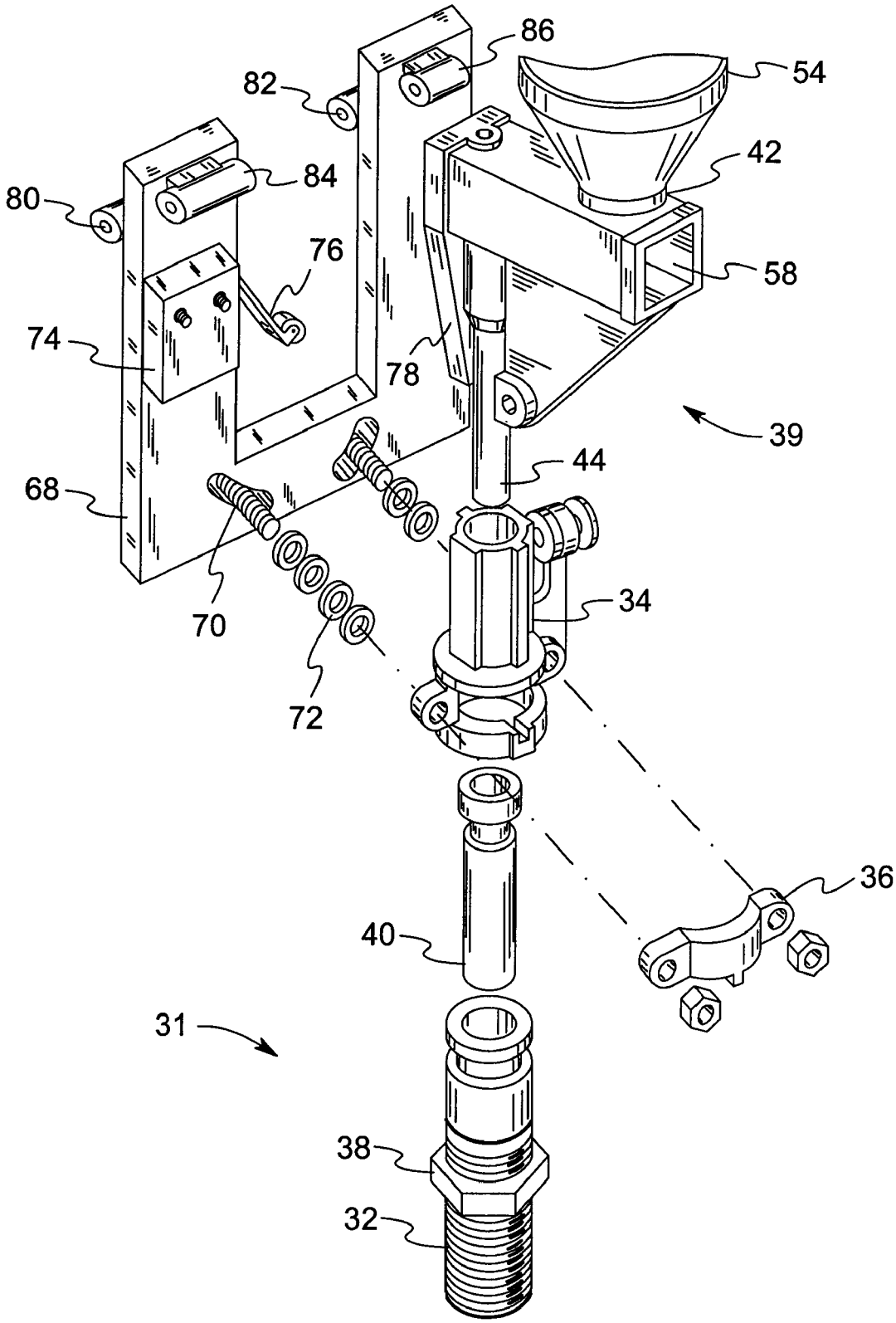
FIG. 2 is an exploded view of the power measure assembly of FIG. 1.

The illustrated tool 30 at the second workstation is a powder measure assembly 30, which is representative of various designs for powder drop tools that are commercially available. The typical purpose of this type of tool is to drop a measured quantity of powder into a shell case. FIG. 2 best shows the components of a powder measure assembly 30. For purposes of the invention, the powder measure assembly is defined by two subassemblies that move with respect to one another. One subassembly is stationary with respect to the tool platform during operation of the reloading machine. The second subassembly is movable between a repose position and an elevated position. When at repose height, the lower end of the second subassembly is positioned such that a shell case of excess length will raise the second subassembly as the shell case axially enters the powder measure assembly. The shell case enters the powder measure assembly when the shell platform and tool platform move toward one another over a stroke of defined length. The second subassembly includes a contact member that is aligned with the axial path of a shell case at the workstation. The contact member is configured to engage with the open end of the shell case by direct abutment, such that the abutted end of the shell case raises the second tool subassembly. The maximum attained height of the second subassembly becomes directly indicative of the shell case length. In the powder measure assembly 30 and in various other commercial powder drop tools, the second subassembly must be raised to dispense a charge of powder into the shell case. Thus, in this embodiment of the invention, a shell case of a specified length and caliber will raise the second subassembly from repose height.

The first embodiment of the length checking invention incorporates a trip device that operates between the first and second subassemblies. The trip device senses a selected height limit of the second subassembly. At the selected height limit, the trip device triggers a response to produce a remedial action. The remedial action might be removal of the identified shell case from the reloading machine. This response might be carried out by an automated removal system or by manual removal. For manual removal, the response might be an alarm for alerting the machine operator that an overly long shell case has been identified. The appropriate selected limit is a height indicative that the shell case is of excess length. An adjustment mechanism allows the limit to be adjusted to accommodate with the different length specifications of various shell case calibers.

The first subassembly 31 of the powder measure assembly 30 is an outer housing or outer sleeve that is mounted to the tool platform. For example, the first tool subassembly 31 includes a powder die 32 with exterior threads and interior cylindrical bore of a diameter large enough to freely receive a shell case of the preselected size or caliber. The threaded exterior of the die variably engages the threads of bore 16, such that the powder die can be screwed into or out of the workstation bore in order to adjust the height of the die 32 with respect to a known caliber shell case to be reloaded.

Optionally, the powder die 32 is connected to a body collar 34 by a clamp 36, such that the powder die 32 and body collar 34 both are substantially stationary in height. The body collar 34 has a central bore aligned with the central bore of the die 32. When the powder die 32 and body collar 34 are clamped together, their position with respect to the tool head 10 is determined by the degree to which powder die 32 is threaded into bore 16.

A powder die lock ring 38 is screwed against the tool head 10 to secure the position of the threaded engagement so that the powder die will remain in a static position on the tool head during reloading operation. Therefore, the powder die 32, optionally with body collar 34, can be viewed as forming the first tool subassembly 31. Typically, these components or their equivalent are substantially fixed together during use. In particular, the powder die 32 is adjusted to a fixed height in order to process shell cases of a selected caliber. The fixed height should remain constant with respect to the tool platform 10 during the operation of the powder charging station to reload a preselected caliber of shell case.

The second tool subassembly 39 of the powder measure assembly is an inner sleeve that is movable in the bore of the outer sleeve and is in communication with a device that dispenses powder in response to elevation of the inner sleeve. As an example, the second tool subassembly 39 may include a vertically movable powder funnel 40 that is configured as a cylindrical sleeve. At least a lower portion of the powder funnel fits within the central bore of powder die 32. Optionally, an upper portion of the powder funnel fits within the bore of body collar 34, where used. A stop, such as a wider top collar on the upper portion of the powder funnel, retains the powder funnel against exiting the die 32 through the open bottom of the die bore. However, the powder funnel can slide up and down in the bore of the powder die and through a portion of the bore in the optional body collar 34.

In this example, another portion of the second tool subassembly 39 is a powder body 42 that serves as a means for dispensing powder in response to being elevated with respect to the first subassembly. According to a commercially known arrangement, the powder body 42 includes a depending sleeve-like tube that slidably fits into the top of the bore in body collar 34. Specifically, the powder body 42 includes a depending powder discharge tube 44 that slidably fits into the body collar bore. The top of the powder funnel 40 and the bottom of the discharge tube 44 are suitably sized to abut against one another, enabling the rising powder funnel to press against and raise the discharge tube 44 along with the remainder of the powder body 42. Similarly, when the powder funnel 40 lowers from an elevated position, powder body 42 can lower with respect to the powder die 32, often under force of gravity aided by a tension spring.

A modified powder body or its equivalent might define the second tool subassembly 39 without requiring a separate powder funnel. The lower end of the discharge tube 44 could be configured to serve the equivalent function of a powder funnel, which could eliminate the need for a separate powder funnel. However, the use of a separate powder funnel is economical, because the powder funnel can be changed to accommodate various types, sizes, or calibers of shell cases. Therefore, a separate powder funnel is a desirable component of the second tool subassembly 39. Both the powder funnel 40 and the powder body 42 are portions of the second tool subassembly 39 in a typical commercial application. As a general definition, the second tool subassembly 39 of the powder measure assembly is that portion of the powder measure assembly that is proportionately elevated by a shell case of predetermined caliber entering a properly adjusted powder die.

The operation of the powder measure assembly 30 to release a powder charge requires an interaction with shell platform 50. In order for a shell case 46 to longitudinally abut and raise the second tool subassembly 39, the shell platform 50 must raise the shell case 46 with respect to the first tool subassembly. The shell case 46 must be longitudinally aligned with tool 30 to enter the open lower end of the vertical bore through powder die 32. The shell plate 48 provides the longitudinal alignment. The shell plate 48 rotates to indexed stopping points on the shell platform 50. The shell plate carries shell cases 46 in defined conveyor stations or clips that are arranged in a circle of similar size to the circle of workstations. At the indexed stopping points, a conveyor station is aligned with each workstation; and a shell case 46 carried in a conveyor station at powder measure assembly 30 is longitudinally aligned with the bore of powder die 32. Correspondingly, the lower end of powder funnel 40 is axially aligned with the shell case 46.

The shell platform 50 moves axially toward and away from the tool platform with a stroke of fixed length. Optionally, a guide rod through tool head bore 26 may ensure axial alignment between the shell platform 50 and tool head 10. The top of the fixed stroke length is at a predefined closeness or minimum separation from the bottom of the tool platform. This minimum separation is sufficiently close to the tool head 10 that each tool can be adjusted in its threaded bore to receive the necessary portion of a specified caliber of shell case for proper of the tool. Because the shell platform 50 raises all of the shell cases 46 in the shell plate 48 by the same stroke distance, it may be necessary to separately adjust the height of each tool for its own proper operation. For example, the degree of threaded engagement between powder die 32 and workstation bore 16 is adjustable. The powder die 32 may be screwed further into the bore 16 to increase closeness with shell platform 50 and thereby increase engagement with shell case 46 of specified caliber, or vice versa.

Figure 4:
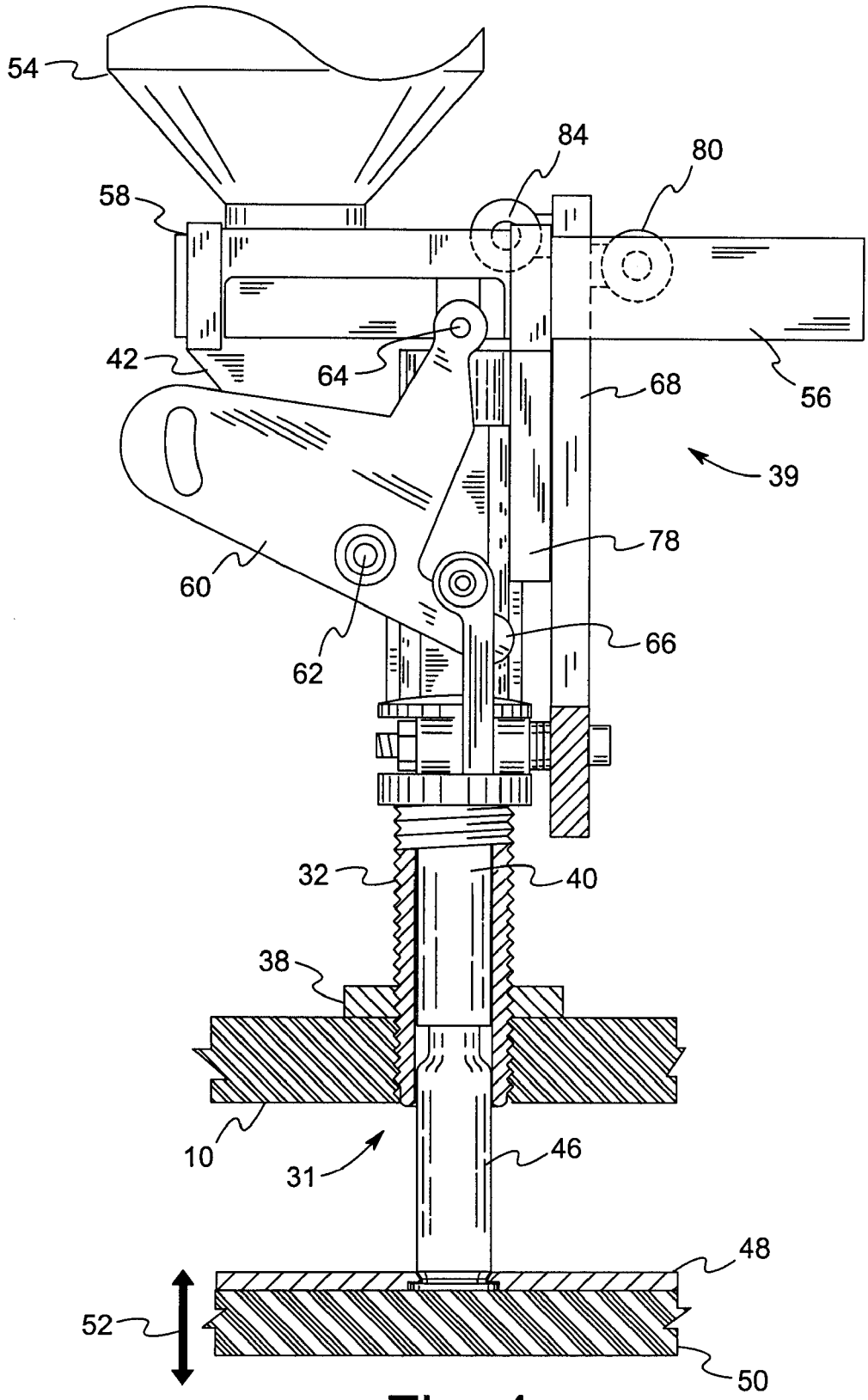
FIG. 4 is a view similar to FIG. 3, showing the shell platform in raised position such that the rifle bullet is partially inserted into the powder die, raising the power funnel and portions of the powder measure assembly with respect to the powder die.
Figure 5:
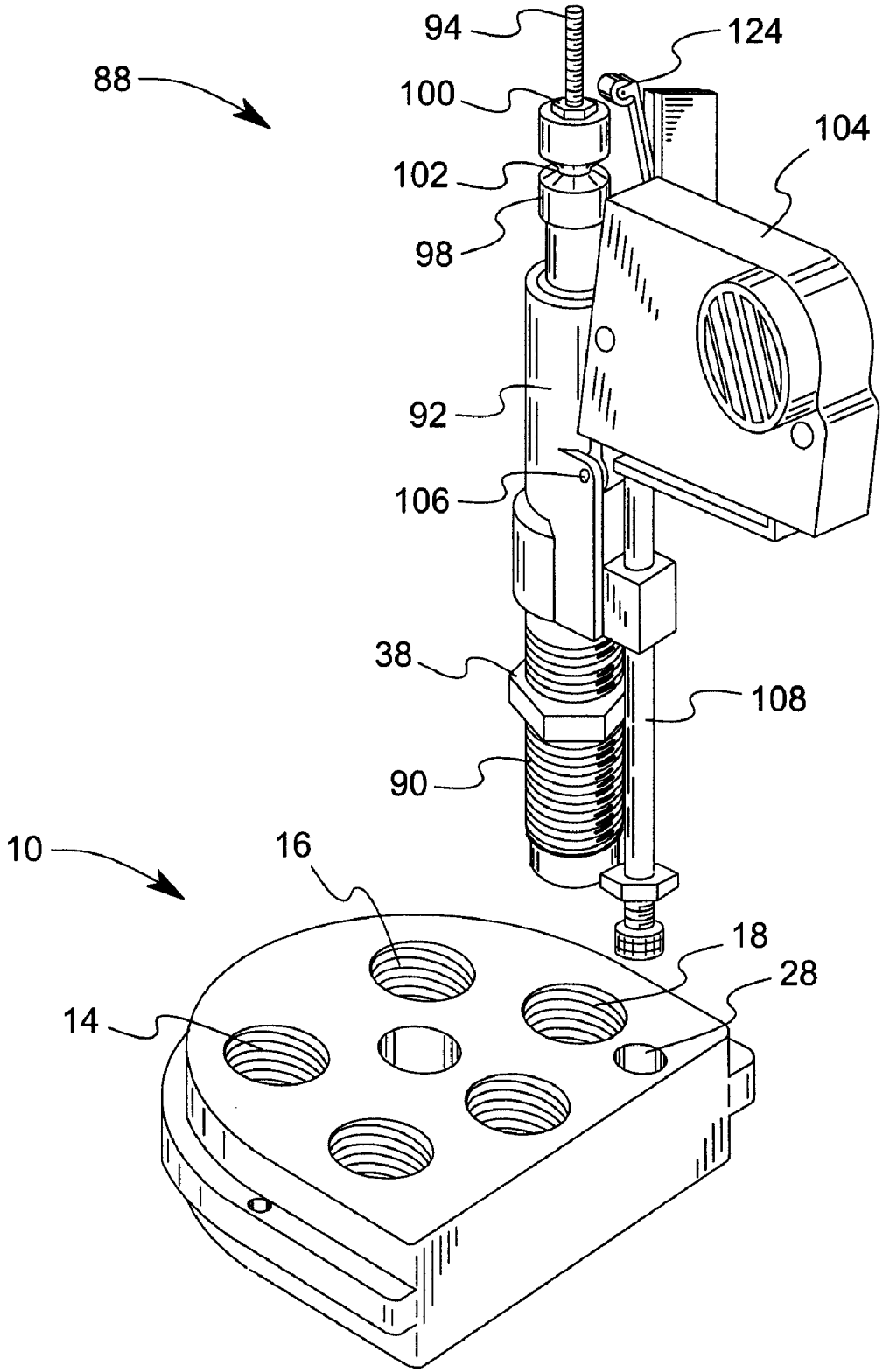
FIG. 5 is an assembly view of a portion of a progressive reloading machine showing a tool head with five workstations, showing a front left view of a powder check system with powder check die positioned for installation at workstation position three, and showing a case length alarm device installed on the powder check system.
Figure 6:
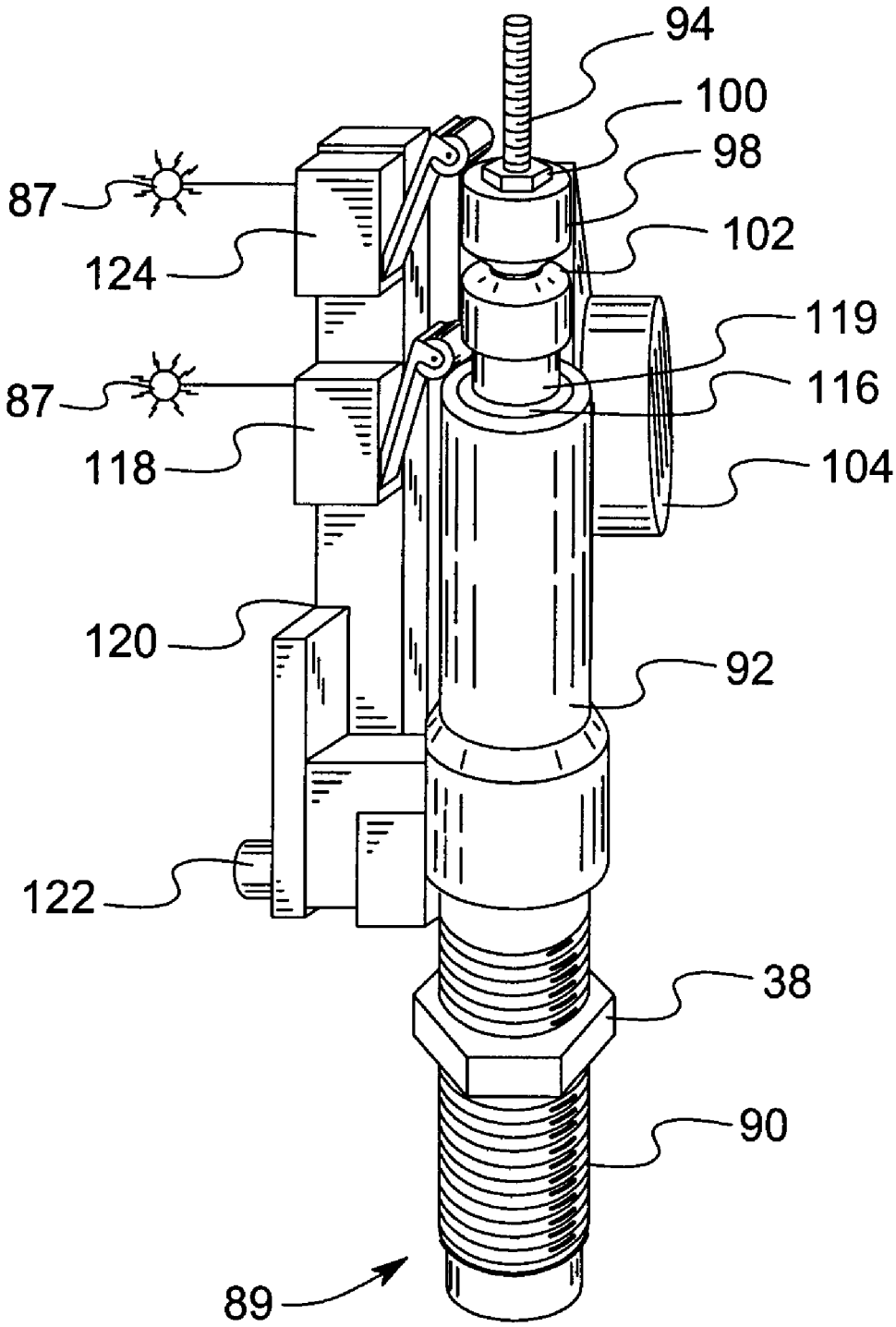
FIG. 6 is an isometric view of a power check system, showing a rear view thereof.

FIG. 4 shows the shell platform 50 at the top of a stroke, where shell cases 46 must be sufficiently and properly pushed into the tools or dies at the workstations. Some types of tools, such as the powder checking assembly, may require considerable closeness, such as one-eighth inch, between the top of the elevated shell plate 50 and the bottom a the powder check die. FIG. 4 shows a shell case 46 engaged in a powder die 32 at the powder charging workstation. The shell platform 50 also lowers from elevated position to withdraw the shell cases from the tools at the workstations.

Figure 3:
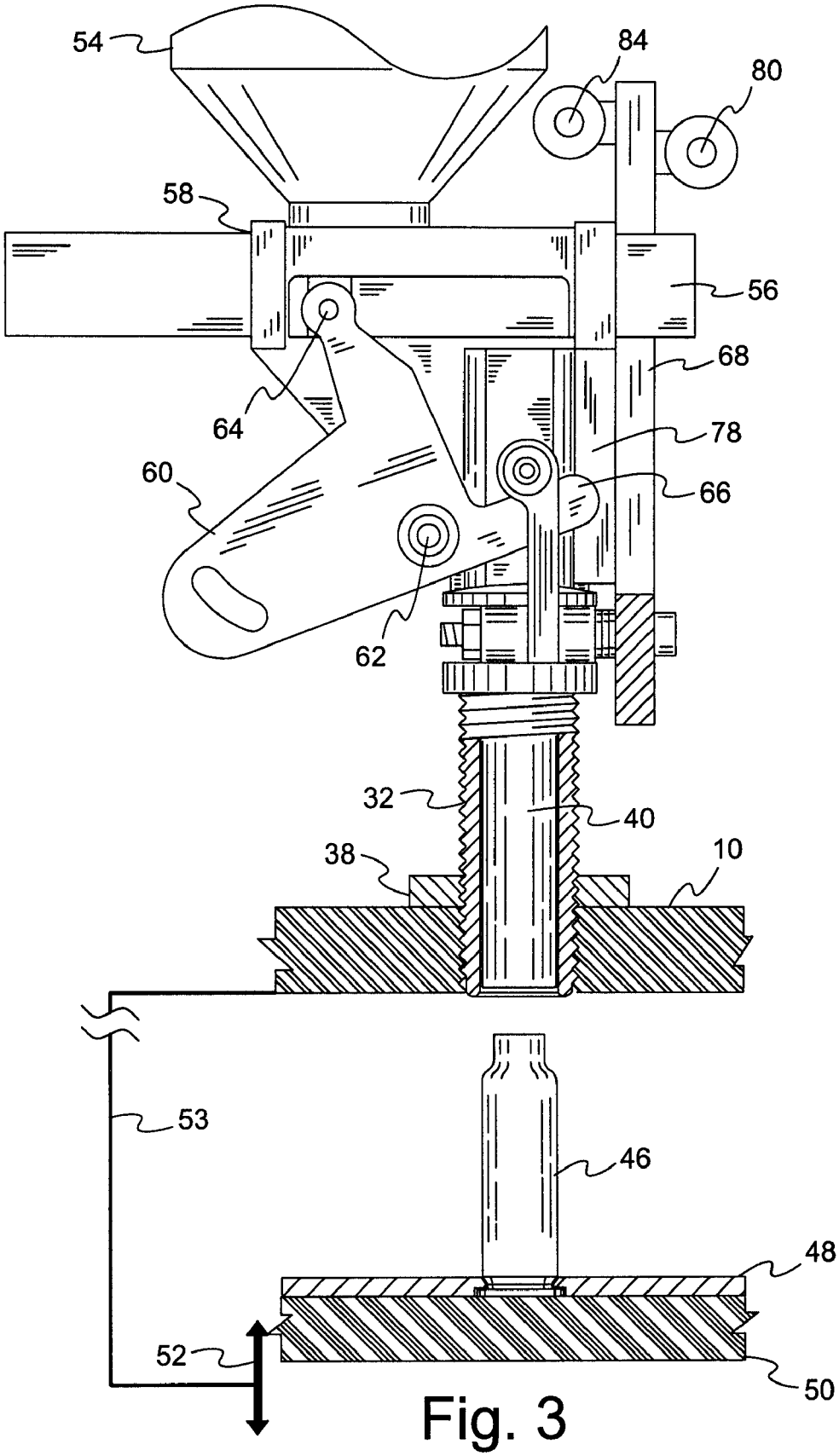
FIG. 3 is a side elevational view of a portion of a progressive reloading machine showing a partial tool head carrying a powder measure assembly with a lower side portion of the power die in partial cross-section to reveal the powder funnel, showing a partial shell platform with shell plate carrying a rifle cartridge case, and schematically showing a frame carrying an elevation mechanism located below the tool head.

In a progressive reloading machine, the stroke length must be sufficient to lower the shell cases below the mouths of the tools so that the shell plate can rotate the shell cases to the next index point. FIG. 3 shows the shell platform 50 at the bottom of a stroke, carrying shell cases 46 below the tool head 10 and below the lower ends of the tools, such that the shell cases have sufficient headroom to advance laterally from one workstation to the next workstation. The headroom between the lowered shell plate and the tool platform should establish sufficient clearance for all shell sizes that can be reloaded in the progressive reloading machine and should include headspace sufficient to accommodate the shell cases after bullets are installed. Accordingly, FIG. 3 schematically illustrates frame 53 to have a gap in its height between the tool platform 10 and elevator mechanism 52. The gap indicates that the frame may have still greater height than is illustrated.

A suitable elevator or reciprocal drive mechanism elevates and lowers the shell platform. A hand-operated mechanism is preferred to allow an operator to correct any problem, such as discovery of a shell case that is longer than specification. A progressive reloading machine may employ a lever and crank mechanism or a swinging toggle drive linkage, as known in the art, to axially raise and lower the shell platform 50. The directional arrow 52 schematically represents a suitable elevator drive mechanism, such as the referenced swinging toggle drive linkage or any other mechanism suitable for raising and lowering the shell platform 50 in a progressive reloading machine. The machine frame carries the elevator mechanism 52 and therefore mechanically positions the elevator mechanism with respect to the tool platform 10.

The elevation of a shell case 46 into a properly adjusted powder die 32 also elevates the second tool subassembly 39. The elevation with respect to the tool platform is indicative of or proportionate to the length of the shell case 46. At the powder charging workstation, the upward stroke of the shell platform 50 elevates the shell case against the lower end of the powder funnel, raising both the powder funnel 40 and powder body 42. The relative distance by which the powder funnel raises the powder body allows the taking of a measurement indicative of the shell case length. Therefore, the invention provides a means for measuring or checking how high the powder body is elevated. If the elevation is beyond a preselected point, thereby indicating that the shell case is too tall, the invention triggers an alarm or other remedial action.

In the normal operation of the powder measure assembly 30, at least two indications show the length of the specific shell case being reloaded at the powder measure workstation 16. The first measure, which has been described, is the vertical offset of the raised second tool subassembly 39 or powder body 42 from repose position. This height can be measured with respect to the first tool subassembly 31 or the tool platform 10. It is necessary to first calibrate the powder measure assembly 30 by adjusting the height of the first tool subassembly 31, which adjusts the engagement height of powder die 32 with respect to tool platform 10. The adjustment is made by first placing a shell case 46 of specification length in the shell plate 48 at the powder charging workstation; raising the shell platform 50 to the top of its stroke; and finally, adjusting the mounting depth of the powder die 32 in tool head bore 16. Once the powder die 32 is set at proper height with respect to the tool head 10 for the preselected caliber or shell case length, the length of any other shell case of the same caliber is reflected by the elevation of the second tool subassembly 39 or powder body 42, when the shell platform is at the elevated to the top of its stroke.

The initial height adjustment primarily ensures that a charge of powder will be properly released into the shell case. The powder body 42 includes a powder hopper 54 for holding a supply of gunpowder. Below the hopper 54, the powder body carries a powder metering mechanism operated by a height-controlled linkage. In typical operation, the linkage causes the powder metering mechanism to receive a single powder charge when the powder body is in repose position, and the linkage causes the powder metering mechanism to drop the single charge of powder into the aligned shell case when the powder body is in elevated position. As an example from known art, a horizontally sliding powder bar 56 has an inner powder cavity sized to contain a single charge of powder. The powder bar 56 reciprocates in a generally horizontal housing 58 of the powder body 42. According to the view of FIGS. 3 and 4, the powder bar 56 moves to the left in housing 58 in a recharge stroke. The powder bar moves to the right in housing 58 in a discharge stroke. The initial height adjustment ensures the adequacy of these two strokes of the powder bar.

The overhead hopper 54 is suitably ported, such as near the top left end of housing 58, to drop powder into the inner powder cavity of the powder bar. Correspondingly, the inner powder cavity has an open top positioned to register with the hopper port and to receive a charge of powder when the powder bar is at the left end of travel on the recharge stroke. Housing 58 is ported near its lower right end to transmit powder through the discharge tube 44. Correspondingly, the inner powder cavity has an open bottom positioned to register with the discharge tube port at completion of the discharge stroke. When the powder bar is at the right end of the discharge stroke, the powder charge from the inner powder cavity can drop into and through the discharge tube 44.

The raising or lowering of powder body 42 causes the power bar to move through the recharge and discharge strokes. Correspondingly, a shell case aligned with the powder discharge tube actuates the discharge stroke as it elevates the powder funnel in powder die 32; and a shell case actuates the recharge stroke as it allows the powder funnel to drop in power die 32. Although the powder bar will be recharged even if the powder die is empty during a stroke, the powder bar will automatically deliver a charge of powder through discharge tube 44 only when a shell case is present in die 32 and is elevating the powder body 42. The shell case 46 initiates powder delivery when it is raised against the powder funnel 40, in turn raising the powder funnel and the powder body 42. If no shell case is present at the powder charging workstation when shell platform 50 elevates, the powder body will not be raised and no powder will be dispensed.

Powder body 42 carries a bellcrank 60 mounted on a pivot pin 62. The opposite ends of the bellcrank 60 are linked to the powder bar 56 and to the first tool subassembly 31. The linkage controls how and when the bellcrank pivots. When the second tool subassembly 39 is raised with respect to the first tool subassembly 31, bellcrank 60 drives powder bar 56 through a discharge stroke to drop a powder charge through the discharge tube. When the second tool subassembly 39 is lowered with respect to the first tool subassembly 31, the bellcrank 60 drives the powder bar 56 through a recharge stroke to receive a fresh charge of powder from hopper 54.

One end 64 of bellcrank 60 is connected to the powder bar 56 at a position approximately overlying the inner powder cavity. The body collar 34 is linked to the second end 66 of the bellcrank 60. As the rising shell case 46 raises the powder body 42, the bellcrank 60 pivots clockwise on pivot pin 62, from the position of FIG. 3 to the position of FIG. 4. Clockwise motion of bellcrank end 64 drives powder bar 56 through a discharge stroke. At the end of this stroke, the internal powder cavity of the powder bar 56 is positioned to drop its contained powder charge through the discharge tube 44 and into a waiting shell case 46. The length of the stroke of bellcrank 60 and powder bar 56 is a function of maximum shell case height in powder die 32. Therefore, the bellcrank 60 and powder bar 56 are additional components of the second tool subassembly 39 that can be monitored to determine the length of a shell case that is received into power die 32.

Proper set-up of the powder measure assembly 30 achieves a full discharge stroke of the powder bar 56 when the shell platform 50 is at full elevation by a shell case of specification length. Consequently, the threaded height of powder die 32 in tool platform bore 16 is adjusted so that the powder bar 56 travels through a full discharge stroke when the shell platform 50 is fully elevated and has inserted a shell case of specification length into the powder die 32. A shell case that is shorter than specification length will cause the powder bar 56 to travel over a shortened discharge stroke and will lift the powder body less than the height corresponding to a shell case of specification length. A shell case that is longer than specification length will lift the powder body higher than a height corresponding to a shell case of specification length.

The invention provides various means of determining the length of a shell case while the shell case remains in the conveyor mechanism of a progressive reloading machine. One such length determination is based upon relative movement or resultant relative separation between the first tool subassembly 31 and the second tool subassembly 39 of the powder measure assembly. The mechanism that monitors or detects the separation may be either a continuous monitoring device or a threshold-trip device. The measuring device can be mounted in a stationary location with respect to either the first tool subassembly 31 or the second tool subassembly 39 in a suitable manner to determine the relative position of the other subassembly.

Several types of switching devices are suitable for detecting the length of a shell case by monitoring the resultant height of a raised powder body in a progressive reloading machine. One type is a microswitch that is actuated by the position of a trip lever. For example, the microswitch is attached to a first tool subassembly 31 of the powder measure assembly. The trip lever is placed to track an inclined surface of a second tool subassembly 39. The chosen inclined surface should be oriented to converge or diverge from the microswitch as the powder body rises under the force of the rising shell case.

An adjusting device sets the position of the monitoring switch to signal when a shell case is of specification length or non-specification length by monitoring the relative positions of the first and second tool subassemblies of the powder measure assembly. An adjusting device permits the switch to be suitably positioned to trip at an appropriate height of the second tool subassembly 39 with respect to the first tool subassembly 31 or tool platform. The chosen trip height should correlate with a case length exceeding specification for the caliber or specification length of shell case being processed.

Another type of switching system is a laser and laser detector pair, which can detect when the laser beam is unbroken or broken. A laser, such as a red diode laser, projects a laser beam over a selected edge of a powder body. The beam is set at a height above the edge such that the edge will break the beam if raised to a height limit indicating a shell case of excess length. The laser detector, which often employs a photo transistor that is sensitive in the visible light range from 630 to 680 nm, senses the break and actuates a signal to indicate that the presently processed shell case has excess length.

The second tool subassembly 39 of a powder measure assembly includes elements that move laterally as well as vertically in response to a rising shell case. For example, powder bar 56 and bellcrank 60 follow an arcuate path as the powder body rises. These elements also provide suitable surfaces for triggering an excess-length alarm. Alternatively, the switch might be mounted to the second tool subassembly 39 with the trip lever or laser beam interacting with a structure of the first tool subassembly 31. When a laser beam is used, the tripping event might be either the breaking or the restoration of the beam. Thus, the laser beam could monitor the passing of a bottom edge of the powder body as the powder body rises.

While a switch might be mounted directly on a powder measure assembly 30 in perfect adjustment, a mounting adaptor can provide better adjustability and stability. An adaptor plate can provide a stable mount, ensure accurate alignment with respect to different sites on the adapter plate, and provide specific means for adjustment. In addition, an adaptor can have a configuration selected to correlate with a specific brand or model of powder body. The adaptor configuration can provide a mounting base at an advantageous location.

As an example, a mounting bracket 68 is readily attached to a powder measure assembly 30 having the structure shown in FIGS. 1-4. Typically, adjustable mounts employ a compression fastener such as a bolt and nut or machine screw acting through an arcuate mounting slot 70. Pre-existing mounting locations may exist on the body collar 34. For example, clamp 36 provides mounting bores for fasteners to close the clamp 36 and attach the powder die 32 to body collar 34. Without significant modification of the first tool subassembly 31, the existing mounting bores can be adapted to join bracket 68 to the body collar 34. Shims such as washers 72 fill any gap between a flat bracket 68 and a cylindrical body collar 34.

The illustrated bracket 68 is U-shaped with two upright arms, one generally disposed on each of the opposite sides of the powder body. Each upright arm provides a potential mounting base for a selected switch. Thus, in the embodiment of FIGS. 1-4, the bracket is mounted to the first tool subassembly 31 and can be considered to be stationary in location while the second tool subassembly 39 is movable.

A microswitch 74 is mounted to an arm of bracket 68, such as by a fastener through an arcuate adjustment hole 75 in the bracket. A spring-loaded actuator arm 76 controls the switch 74 by closing the switch when the actuator arm has swung sufficiently far from the switch.

The powder body 42 may include various gussets or similar reinforcing structures with an inclined edge, such as inclined edge 78. Switch 74 is positioned on bracket 68 with actuator arm 76 biased against the inclined edge 78. As the powder body 42 is raised to trigger the release of a powder charge, the distance between the microswitch 74 and inclined edge 78 increases, allowing actuator arm 76 to extend. The bracket 68 may supply mounts with arcuate holes 75 for the microswitch, or the microswitch may define the arcuate mounting holes. In either arrangement, by appropriately adjusting the position of microswitch 74 on bracket 68, the arm 76 will be positioned to reach a trip point when the height of the powder body exceeds the limit correlating with a shell case that is within length specification.

The inclined surface 78 may be an addition or modification of the powder body, as necessary. For example, a plate with edge 78 can be fitted to the powder body by any convenient means, including adhesive mounting. Even when a gusset with inclined surface 78 is available, the incline may be modified in order to provide a more desirable contour. Grinding or filing the incline 78 will modify the angle and thereby adjust the trip point on a switch. A supplemental plate or gusset may be added to the powder body in order to supply an independent inclined surface of any desired contour. The position of the microswitch 74 is adjustable by moving the switch 74 on the bracket 68, such as with arcuate mounting slots 75, or by moving the bracket 68 on the powder body 42, such as by arcuate mounting slots 70.

As an example of a laser beam switch, a laser 80 is mounted to the first tool subassembly 31, such as on bracket 68, in a position projecting a laser beam over an edge of the second tool subassembly 39. A laser receptor 82 is mounted on the first tool subassembly 31 in a position separated from the laser 80, across the selected edge of the second tool subassembly 39. The positions of the laser and receptor are set at a height such that the selected edge breaks the beam when raised sufficiently to indicate that a shell case is longer than specification.

FIGS. 3 and 4 show examples of surfaces or edges that can be monitored. The laser and detector pair 80, 82 might monitor the top edge of the powder bar 56. Another laser and detector pair 84, 86 might monitor the top of the powder bar housing 58. Bracket 68 may be configured as required or mounted at a location as required to support a laser and detector pair. The laser and detector pair can monitor the height or position of any suitable edge or surface of the second tool subassembly 39.

An alarm 87 is associated with or connected to the switching device. The alarm may broadcast any type of signal. A suitable signal might be an audible signal such as a buzzer or a visual signal such as a light. FIG. 1 schematically shows signaling devices 87.

The invention is suited for use with powder drop mechanisms that may differ in construction or operation from details of illustrated powder measure assembly 30. For example, other commercially available devices employ a rotor or rotary drum in place of the sliding powder bar 56. With decreasing elevation, a height responsive linkage rotates the drum by a partial turn in one direction to a position where the hopper drops a powder charge into the drum. With increasing elevation, the linkage rotates the drum by a partial turn in the opposite direction to a position where the drum drops the powder charge into the waiting shell case. Accordingly, the invention is not dependent upon any specific powder measure or powder drop mechanism. The invention requires only that a shell case induces movement of a portion of the powder drop workstation by a distance that is indicative of shell case height.

Figure 10:
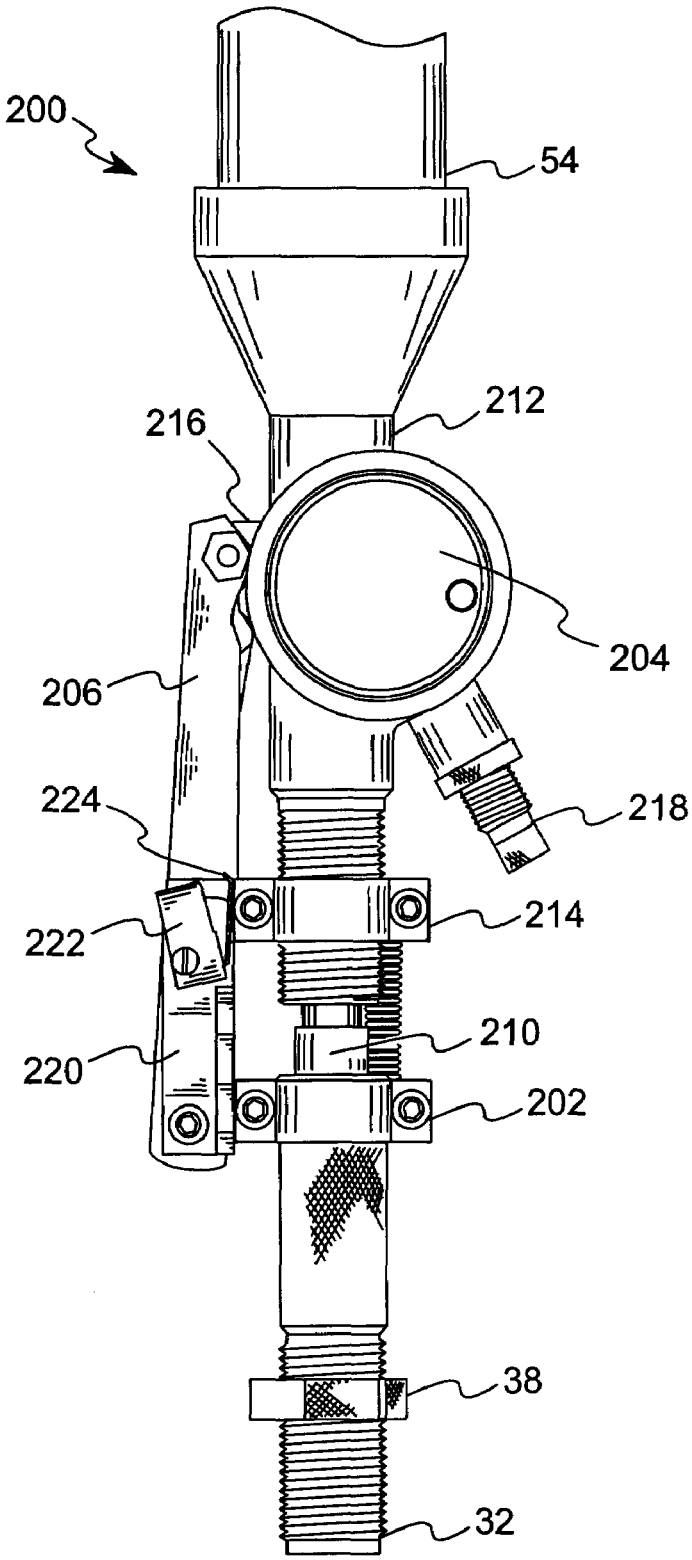
FIG. 10 is a side elevational view of another embodiment of a powder measure assembly including a means for detecting excess case length, showing portions of the powder measure assembly in repose position.
Figure 11:
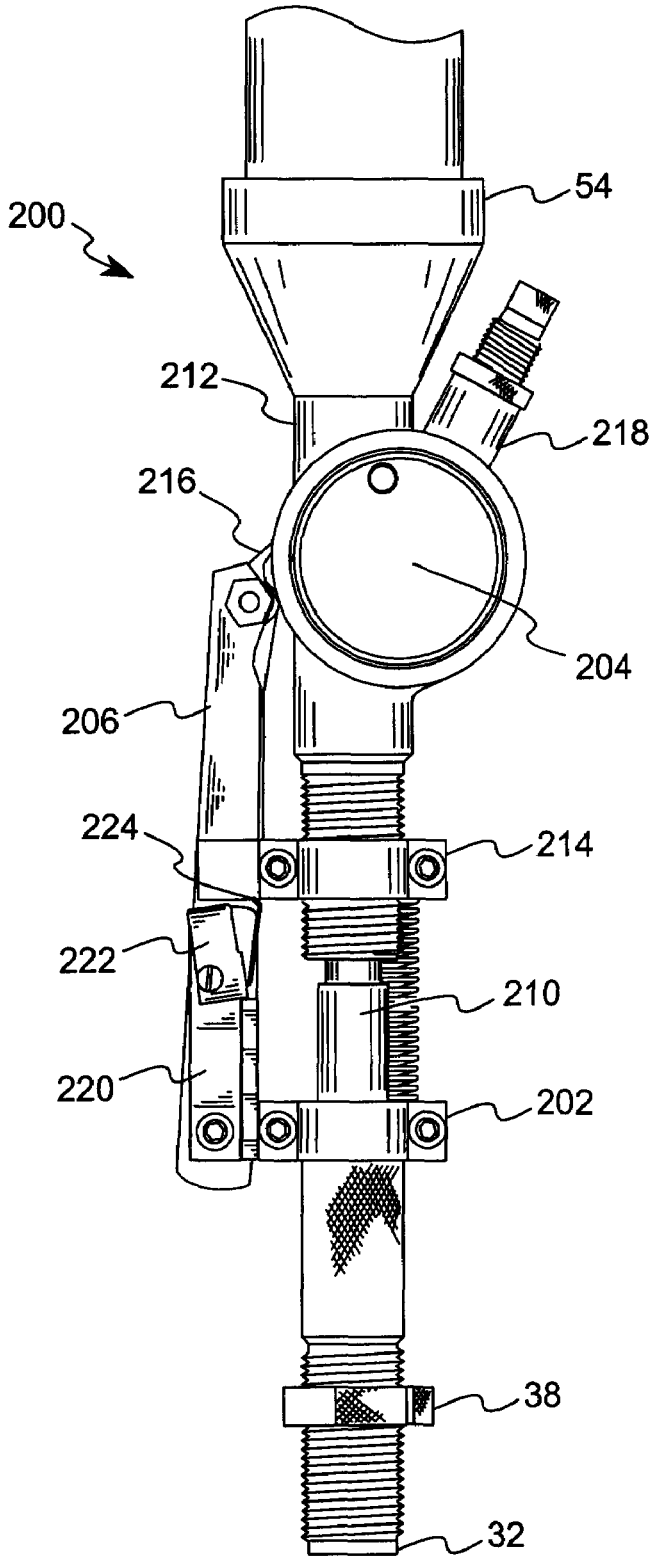
FIG. 11 is a view similar to FIG. 10, showing portions of the powder measure assembly in elevated position to trigger the means for detecting excess case length.

As an example of a powder drop mechanism employing a rotor as a powder drop mechanism, FIGS. 10 and 11 show a modified powder measure assembly 200. Many parts of powder measure assembly 200 are similar to those of previously described power measure assembly 30. The previously used identifying numbers will be used to identify the same of closely similar parts of powder measure assembly 200.

Like powder measure assembly 30, powder measure assembly 200 is formed of a first, stationary or nonmoving subassembly and a second movable subassembly. The stationary subassembly is primarily formed of a powder die 32 that has threaded engagement with a bore in a tool platform as previously described. A lock ring 38 secures the threaded engagement with the tool platform at a selected height. The stationary subassembly also includes a lower clamp 202 that can be secured to the powder die 32 by locking bolts. The lower clamp 202 serves as a stable mounting base for a linkage arm 206.

The second, movable subassembly includes a powder funnel, drop tube, or combination of similar members suited to be contacted and raised by a shell case being raised within the powder die 32. FIG. 10 shows a drop tube 210 in repose position, while FIG. 11 shows the same drop tube 210 in elevated position. The drop tube 210 is connected to a powder body 212 such that the drop tube elevates the powder body 212 when a shell case elevates the drop tube. FIG. 11 further shows the entire powder body 212 in elevated position. The lower end of the powder body 212 is threaded and carries an upper clamp 214 that is adjustable in height on the threads. The upper clamp serves as a stable mounting base for a linkage arm 216, which may be parallel to linkage arm 206 and is mostly hidden in the drawing figures. The two linkage arms are portions of a commercially sold system for operating a powder metering mechanism. Relative movement between the upper and lower clamps causes movement between the arms. The movement can operates various linkages such as a bellcrank 60 or other linkage to rotate a rotary powder metering mechanism.

The powder body 212 differs from the previously described powder body 42 primarily in the configuration of the powder metering mechanism. The powder body 212 carries a rotor 204 that is operated by a linkage actuated by relative motion between linkage arms 206 and 216. A diametric bore through the rotor 204 defines a powder measuring volume, and an adjustable plunger mechanism 218 operates in the bore to adjust the volume. The bore has an open end opposite from plunger mechanism 218. In the view of FIG. 10, the open end of the bore is near the top of the rotor 204 and is positioned to receive a charge of powder from hopper 54. In the view of FIG. 11, the open end of the bore is near the bottom of the rotor 204 and is positioned to discharge the charge of powder through the bottom of the powder body 212 and through drop tube 210 into a shell case.

The invention is applied to the powder measure assembly 200 by attaching a microswitch carrier bracket 220 to lower clamp 202. The microswitch carrier bracket 220 carries a microswitch 222 with its actuator arm 224 positioned to engage the second, movable subassembly. When the second subassembly is in repose position, the actuator arm 224 may rest against the upper clamp 214, as shown in FIG. 10. However, when the second subassembly is in elevated position as shown in FIG. 11, the upper clamp has been elevated with respect to the microswitch. The actuator arm 224 now has crossed a lower edge of the upper clamp such that the actuator arm 224 has moved to trigger an alarm. The microswitch 222 can be adjusted in position on bracket 220 with respect to the upper clamp 214. Suitable adjustments will cause the microswitch to trigger an alarm when a shell case of excess height raises the second subassembly by a correspondingly great amount.

FIGS. 5-9 disclose a second embodiment of a case length limit detector at a powder level checking station. The tool platform 10 carries a powder level check assembly 88 at third bore 18. Conventionally, the powder check assembly determines whether a shell case has received a double charge of powder or no charge of powder. Measuring the level of powder in the shell case enables this determination. If the level of powder is approximately correct, indicating a normally charged case, the station issues no alarm. However, if the charge is significantly low or high in level, a buzzer sounds. The operator can then remove the case from the shell plate before it is processed at the bullet seating station.

The powder level check assembly 88 provides three subassemblies that are capable of separate movement. A first tool subassembly 89 is an outer housing or outer sleeve and that is mounted to the tool platform. For example, the first tool subassembly 89 may be a powder check die 90 that is threaded into tool head bore 18. The die 90 has exterior threads and defines a substantially vertical interior cylindrical bore of a diameter large enough to freely receive a shell case of the preselected caliber. The threaded exterior of the die variably engages the threads of bore 18, where the powder check die can be screwed into or out of the workstation bore in order to adjust the height of the die 90 with respect to a shell case being reloaded. The outer sleeve is fixed at a preselected height to the tool platform. A second tool subassembly 91 may be an inner sleeve that is slidable in the bore of the outer sleeve of the first tool subassembly 89. The inner sleeve is sized and positioned to engage the leading end of a shell case entering the bore, abutting the lower end of the inner sleeve. In addition, the powder level check assembly includes a central subassembly that is vertically slidable within the second tool subassembly 91.

The height of die 90 is adjustable in tool head bore 18 to accommodate shell cases of different lengths or calibers. A suitable adjustment places the lower, open end of die 90 near the top of the elevated shell platform 50, such as within one-eighth inch. Thus, proper adjustment can place the lower, open end of die 90 well below the tool platform 10. The die can be interchanged with dies of different sizes, as required, to accommodate different calibers of shell cases. A die lock ring 38 can be screwed down to secure the die 90 to tool head 10 at the adjusted height during reloading operations. The inner bore of the die 90 is large enough in diameter to freely receive the caliber of shell case being processed without substantially altering the length of the shell case. A die collar 92 optionally is provided as a separate unit that clamps to the top of die 90, or the structures of the die 90 can incorporate the structures of the die collar 92 in a single unit. The die collar has a central bore aligned with the bore of the die 90. The die 90, optionally combined with a separate, attached die collar 92, constitutes the first or stationary powder check subassembly 89, in that these components function while in a fixed position with respect to tool head 10.

The central subassembly includes a vertically slidable powder check rod 94 that extends through the central bore of die 90 and die collar 92. The powder check rod 94 carries a foot 96 sized to enter a shell case of a particular caliber or range of calibers. The foot 96 can have larger diameter than rod 94 in order to contact the top of the powder charge without penetrating the charge. The foot 96 is narrower than the case mouth and freely enters and exits the case mouth. The top of powder check rod 94 is threaded and carries an alarm sleeve 98 adjustably threaded to the rod 94. A jamb nut 100 locks the sleeve in selected position on the rod 94. The sleeve includes an annular groove 102 as a reaction surface for a buzzer contact pin, described below.

As a part of the powder level checking operation, the powder check rod 94, foot 96, alarm sleeve 98, and jamb nut 100 are movable in elevation with respect to the first tool subassembly 89, and also with respect to tool head 10. These components also are movable in elevation with respect to the second tool subassembly 91. In operation, the movement of the central subassembly is proportional to powder height in a case rather than to case length.

The die collar 92 supports an external buzzer 104 on a pivot shaft 106. The die collar 92 also carries an external pushrod 108 that extends through the tool head 10 at bore 28. The bottom of pushrod 108 vertically aligns with a portion of the shell platform 50, such as with a raised peripheral edge 110 of the shell platform. Edge 110 provides a reference level on the shell platform for establishing a reference height of the shell platform. The top of the pushrod is aligned with the buzzer at a location offset from pivot shaft 106, such that the pushrod can be raised to pivot the buzzer on shaft 106. The lower end of pushrod 108 carries a length adjusting screw for adjusting the pushrod. The pushrod 108 is adjusted to pivot the buzzer 104 by a suitable amount when the shell platform is fully raised.

In conventional operation, the shell platform 50 raises the pushrod 108 while elevating a shell case 112 into the die 90. The foot 96 of powder check rod 94 enters the open mouth of the shell case 112. If powder is present in the shell case 112, the foot 96 rests on top of the powder charge. The powder rises with the elevating shell case to raise powder check rod 94 by a distance indicative of the powder level. Correspondingly, the powder check rod 94 raises the attached alarm sleeve 98, thereby elevating groove 102. At the same time, the shell platform 50 raises pushrod 108 sufficiently to pivot the buzzer 104 on pin 106 by a predetermined amount toward the alarm sleeve 98.

Figure 8:
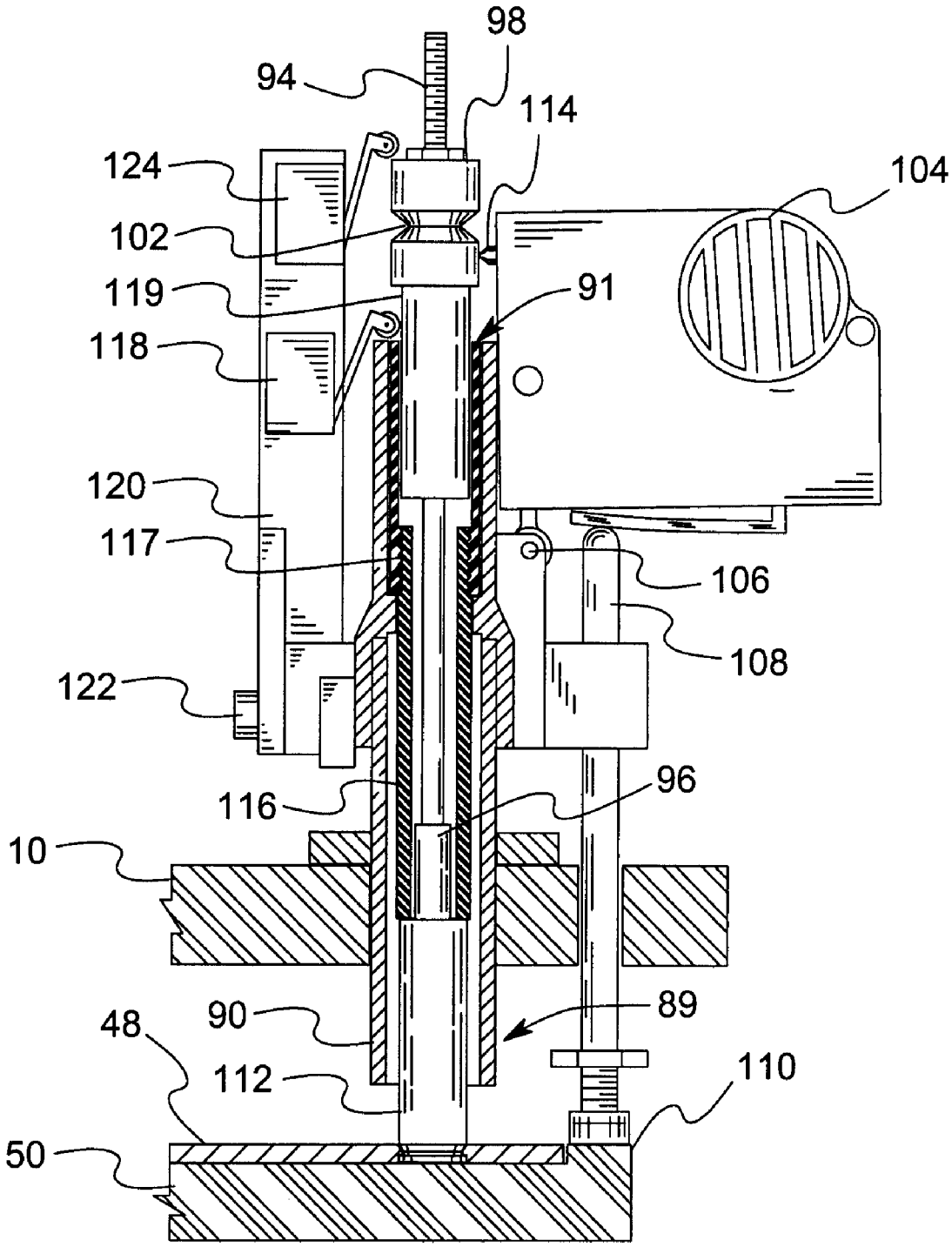
FIG. 8 is a view similar to FIG. 7, showing the shell platform in raised position such that the cartridge case is partially inserted into the powder check die, raising the check rod and die collar to indicate an excess powder charge.
Figure 9:
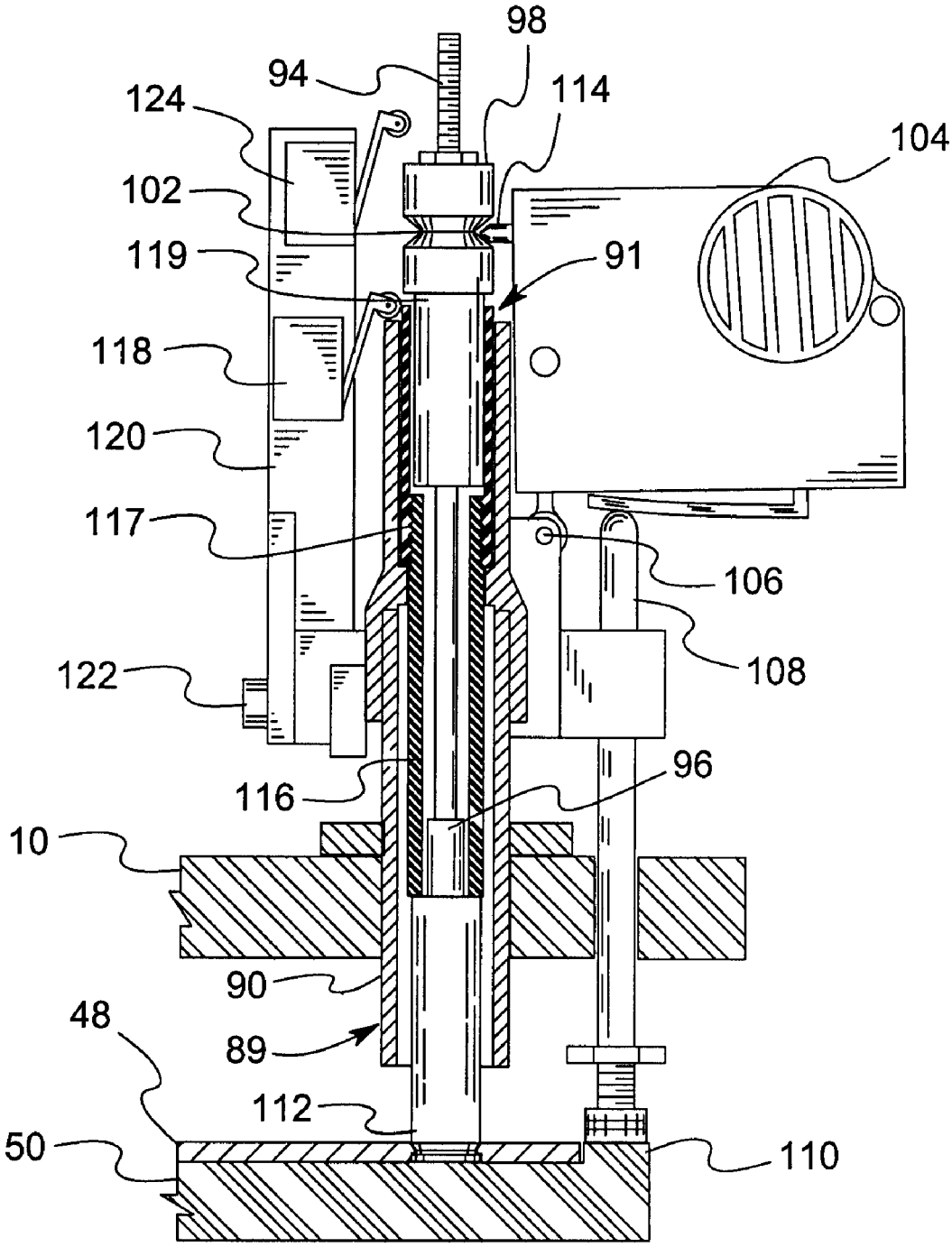
FIG. 9 is a view similar to FIG. 8, showing the length-indicating sleeve raised to indicate excess case length, while the check rod and die collar indicate proper powder charge.

Depressing buzzer contact pin 114 against alarm sleeve 98 actuates the buzzer 104. If the contact pin 114 enters groove 102 as shown in FIG. 9, the pin is protected from being depressed far enough to sound the buzzer. Proper conventional adjustment of alarm sleeve 98 on rod 94 places groove 102 at the level of contact pin 114 when shell platform 50 has elevated rod 94 and an approximately correct powder charge is in shell case 112. As shown in FIG. 8, at any other elevation of the rod 94, contact pin 114 is either above or below groove 102. The pin 114 then will strike alarm sleeve 98 either above or below groove 102, sounding the buzzer. Accordingly, the buzzer sounds with either a missing powder charge or a double powder charge.

Figure 7:
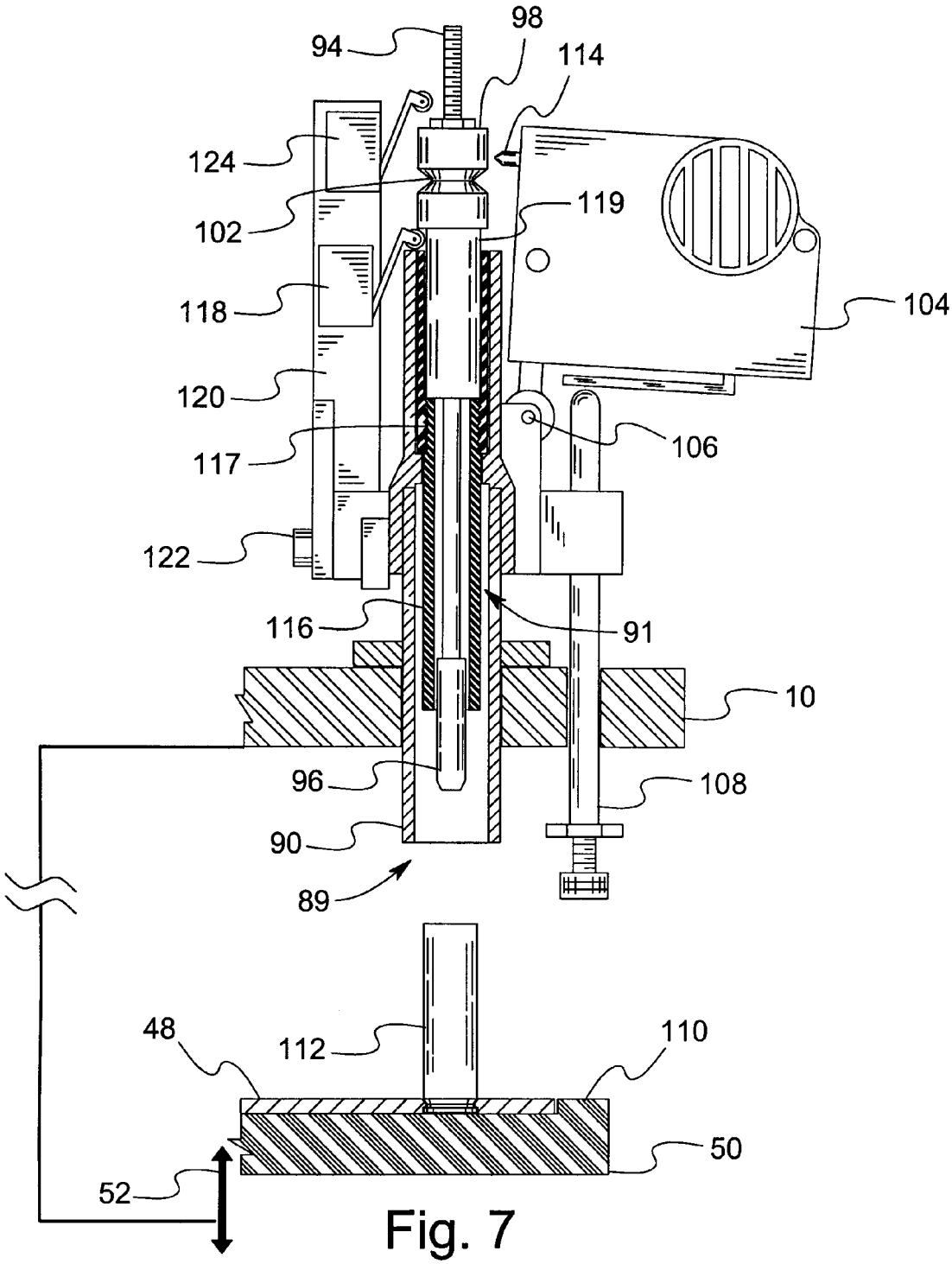
FIG. 7 is a left side view in partial cross-section of a partial tool head with powder check system installed, showing a partial shell platform carrying a cartridge case below the power check die, showing a case length checking device installed on the powder check system, and schematically showing a frame carrying an elevation mechanism located below the tool head.

The second tool subassembly 91 of the powder level check assembly includes a vertically slidable sleeve 116 that contacts the end of a shell case and rises in proportion to case length. A suitable slidable sleeve 116 is located intermediate the previously described first tool subassembly 89 and central subassembly. The intermediate sleeve 116 is positioned at a repose height where abutting end contact with a shell case entering the tool will elevate the sleeve. As an example, FIG. 7 shows intermediate sleeve 116 coaxially positioned in the central bore of die 90 and axially aligned with shell case 112 at an indexed conveyor station of shell plate 48. The lower end of the sleeve is sized to meet the open end of a shell case in abutting contact. The sleeve may be formed of two mating sleeve portions that join at a threaded junction 117. At the junction 117, the sleeve length can be adjusted to accommodate shell cases of different lengths. The junction 117 also creates a lip that reposes on an edge of the vertical bore through the powder check die 90 and die collar 92. Thus, the lip of junction 117 supports the sleeve 116 at repose height.

The shell platform 50 raises the shell case 112 at the powder level check workstation 88. At the index position of the workstation 88, the shell case 112 is longitudinally aligned with the open lower end of die 90 and with sleeve 116. Elevating mechanism 52 elevates shell platform 50 toward the tool platform 10 by a full stroke, thereby inserting shell case 112 into die 90 as shown in either FIG. 8 or 9.

At the powder level check workstation, the intermediate sleeve 116 initially is at repose height. The repose height is a suitable distance from the shell platform when at the top of its stroke, such that a shell case of excess length will raise sleeve 116 at least by the distance of the excess length. Thus, optionally the height of the bottom end of the sleeve 116 may be at a minimum contact height as shown in FIG. 8, where a shell case of specification length does not raise the sleeve from repose height. However, as shown in FIG. 9, a shell case exceeding specification length will raise the sleeve by a detectable amount. If the lower end of sleeve 116 is positioned below the minimum contact height, a shell case of specification length for the caliber also will raise the sleeve. A height detecting device 118 can be set at whatever resulting height of sleeve 116 is appropriate to identify a shell case that is too long.

In this embodiment, the intermediate sleeve 116 serves as the second tool subassembly 91 that is movable with respect to the first tool subassembly 89 in direct proportion to the height of a shell case engaged in the die 90. This embodiment also provides an improved range of application. Substantially any type of shell case, including both pistol and rifle cases, can be measured at a powder level check workstation 88. This measurement is substantially free of applied sidewall stretching forces, which otherwise could alter the case length. In contrast, at the powder measure workstation 30 of FIGS. 1-4, a powder funnel used on a pistol case typically serves an additional function of expanding the mouth of the case. This mouth expansion can alter case length. Thus, only rifle cases can be measured with consistent accuracy at the powder measure assembly 30, unless the mouth expansion for pistol cases is eliminated, such as by moving this function to a different workstation.

The intermediate sleeve 116 has a central bore sized to slidably receive the central subassembly, such as powder check rod 94. The central bore at the lower end of sleeve 116 is large enough for check rod foot 96 to slide freely within the sleeve 116 over the necessary range for the foot 96 to rise during powder level checking operations. The central bore at the upper end of sleeve 116 is large enough to receive a lower end of alarm sleeve 98 and for the alarm sleeve 98 to slide freely within sleeve 116. Optionally, the lower end 119 of alarm sleeve 98 may be reduced in diameter to ensure adequate clearance and free slidability between die collar 92, alarm sleeve lower end 119, and height-detecting sleeve 116, as illustrated in FIGS. 7-9.

A shell case 112 being processed in die 90 raises the intermediate sleeve 116 to a height indicative of any excess length of the shell case. A switch 118 is positioned to react against the top edge of the intermediate sleeve 116. Switch 118 trips when the top edge of sleeve 116 reaches a height indicative of a shell case length greater than specification. A bracket 120 carries the switch. A die collar clamp 120 may connect the bracket to the die collar 92. The clamp offers ready adjustability in height, or the mountings of switch 118 may offer adjustability. When actuated by the height of sleeve 116, the switch triggers an output signal, such as the opening or closing of an electrical circuit. A mechanism such as an alarm or corrective device responds to the output signal. The alarm may be a signaling device 87, FIG. 6.

If a portion 119 of the alarm sleeve 98 is to be reduced in diameter, the full or original diameter should be maintained over a portion of the alarm sleeve 98 both immediately above and below the groove 102. The full diameter portion of the alarm sleeve 98 preserves the ability of the alarm sleeve to trip buzzer 104 when contact pin 114 strikes the sleeve immediately outside groove 102. Optionally, bracket 120 carries a supplemental switch 124 in a topmost position to react against the top edge of alarm sleeve 98. In the situation where portion 119 of the alarm sleeve has been reduced in diameter to accommodate the intermediate sleeve 116, switch 124 may be necessary. A shell case containing too much powder could raise the full diameter portion of alarm sleeve 98 past the contact pin 114. In this situation, the supplemental switch 124 actuates the powder level check alarm to indicate an overfilled case.

In operation, the powder check assembly 18 is located at a workstation that in processing sequence follows any prior workstation at which a shell case might be substantially altered in length. Typically, the powder level check assembly 88 is located next after the powder charging workstation 30. A shell case 112 is carried in an indexed conveyor station of the shell plate 48. At the completion of processing at the powder measure assembly 30, shell plate 48 rotates on shell platform 50 to a next index point, advancing the shell case 112 from the powder measure workstation to the powder check workstation. The resulting configuration is as shown in FIG. 7.

With the shell case 112 at the powder level check workstation, the elevator mechanism 52 raises the shell platform 50 by a predetermined stroke distance, sufficient to introduce the shell case 112 into the powder level check die 90, as shown in FIG. 8. The elevation of shell platform 50 is sufficient to place the lower end of a properly adjusted pushrod 108 into contact with the shell platform 50 at edge 110. The properly adjusted pushrod 108 is of suitable length to be raised against buzzer 104 to pivot the buzzer toward the alarm sleeve 98. At the same time, the foot 96 of a properly adjusted powder rod 94 enters the open end of the shell case 112 and rests against the powder charge, if any, in the shell case.

FIG. 8 shows an example of an excess powder charge coupled with a shell case of specification length. In this example, powder level raises the powder rod 94 with alarm sleeve 98 to a level where buzzer contact point 114 is depressed against the full width of the alarm sleeve 98, thereby actuating the buzzer. At the same time, because the shell case is of specification length, the intermediate sleeve 116 is not raised to the point of tripping switch 118. In FIG. 8, the supplemental switch 124 is above the top of alarm sleeve 98. If the excess powder charge raised the full width portion of alarm sleeve 98 beyond contact pin 114, the top of alarm sleeve 98 would trip the supplemental switch to actuate an alarm 87 as a substitute for buzzer 104.

FIG. 9 shows an example of an acceptable powder charge coupled with a shell case of excess length. In this example, the powder rod foot 96 rests on top of the powder in shell case 112. The acceptable powder charge has raised alarm sleeve 98 to place groove 102 in line with contact pin 114, with the result that the contact pin does not actuate powder level buzzer 104. However, the excess length of shell case 112 has raised the intermediate sleeve 116 by enough distance to trip switch 118. Thus, switch 118 actuates an alarm 87, indicating a shell case of excess length.

In response to any type of alarm at the powder level check workstation 88, the operator of the progressive reloading machine should lower the shell platform 50 and remove the appropriate shell 112 from the shell plate 48. A shell case 112 that progresses through the powder level check workstation without triggering an alarm can be expected to contain a single powder charge and to be within maximum specification length. Accordingly, if no alarm has sounded, the operator lowers shell platform 50, the shell plate 48 rotates by one index interval to bring the shell case 112 to the next workstation, and the steps of the progressive reloading operation continue.

As described, the invention operates in a progressive reloading machine to screen shell cases for proper length as they advance in series through the machine. This determination is made after the shell cases have been sized or otherwise processed in a way that could lengthen a shell case. In each of the described embodiments, the shell case fits freely into the workstation die where the length measurement is made. At these dies, the shell case is not subjected to substantial sidewall contact that causes stretching. In each embodiment at maximum engagement between the case and the die, the shell case aligns with and abuts an upwardly slidable member. In particular, excess length of the shell case elevates the upwardly slidable member to a height where a switch or other tripping or triggering device responds. The switch signals that the slidable member has risen too far, indicating that the specific case being processed at that workstation is of excess length.

The description refers to common motions found in progressive reloading machines. For example, the description refers to the shell platform rising to engage a shell case in a workstation die. An equivalent motion could lower the tool head toward a stationary shell platform, or a tool head and shell platform could converge by mutual motion, all with the same or equivalent resulting operation. Therefore, descriptions of specific motions should be regarded as examples and not limitations.

In another respect, the several embodiments of the invention describe checking shell cases for excess length. Similar techniques could check for shell cases that are too short. The upwardly slidable member may be positioned low enough in the die that a shell case of specification length at least raises the slidable member by a small but determinable amount. A switch or other detector could sound an alarm if the slidable member failed to rise or was raised by less that the determinable amount. In this way, a short shell case would be detected.

A single-station reloading press can employ the invention. Such a press is set up to perform a single workstation task at one time, after which the press is reset to perform the next task. For example, the operator would set-up the press with a sizing and decapping die to size and decap all of the shell cases in a collection. Then the operator would change the tool in the press to a powder drop tool and add powder to all of the shell cases. The reloading steps continue by substitution of a powder check tool, and so on. The single-station press equally can employ a powder drop tool or powder level check tool combined with a case length check mechanism, as described above. Thus, while the advantage of the combined functions is best realized in a progressive reloading machine, a single-station press also benefits from checking case length in a combined operation, after completion of all steps likely to change case length.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A reloading machine configured to check the length of a shell case of preselected caliber against a length specification for such preselected caliber, comprising:

a tool platform defining a workstation;

a workstation tool connected to said tool platform at said workstation, composed of first and second tool subassemblies, wherein:

said first tool subassembly defines a substantially vertical bore with open lower end for receiving a shell case;

said bore is sized to axially receive a shell case of said preselected caliber with sidewall clearance;

the first tool subassembly carries said second tool subassembly for axial movement in said vertical bore between a repose height and an elevated height;

during reloading operation the first tool subassembly is set at a substantially constant height with respect to the reloading platform; and said second tool subassembly is sized and positioned to abut an end of a shell case of the preselected size entering the vertical bore from said open lower end thereof;

a shell platform spaced below said tool platform by a separation that is variable between a maximum and a minimum distance, carrying a shell case of the preselected caliber with open end up, in longitudinally aligned position to the vertical bore of the first tool subassembly;

a drive mechanism operably connected to change the separation between the tool platform and shell platform from maximum to minimum separation, wherein at the minimum separation the shell platform is sufficiently close to said repose height of the second tool subassembly that a shell case of the preselected caliber and length exceeding specification elevates the second tool subassembly by a distance indicative of the length of the shell case;

a detection device arranged to sense the elevation of the second tool subassembly to a selected limit and to trigger an output signal in response to sensing elevation to said limit;

a remedial device connected to said detection device to receive said output signal and to produce a response to the output signal; and an adjustment device operatively connected to the detection device to adjust the selected limit suitably to indicate a shell case exceeding specification, whereby the detection device triggers a response when a shell case of length exceeding specification elevates the second tool subassembly.

2. The reloading machine of claim 1, wherein:

said detection device is a microswitch having a trip lever, wherein the microswitch is carried from one of said first and second tool subassemblies and said trip lever is arranged to trip the microswitch in response to elevation of the second tool subassembly to said selected limit.

3. The reloading machine of claim 1, wherein:

said detection device is a laser directing a laser beam at a laser beam detector, wherein the laser and laser beam detector are carried from one of said first and second tool subassemblies and the other of the first and second tool subassemblies is arranged to interrupt the laser beam when said second tool subassembly is elevated to said selected limit.

4. The reloading machine of claim 1, wherein said workstation tool is selected from the group consisting of a powder measure assembly and a powder level check assembly.

5. The reloading machine of claim 1, wherein said second tool subassembly comprises a sleeve that is slidable in said vertical bore.

6. The reloading machine of claim 5, wherein said workstation tool comprises a powder measure assembly and said sleeve comprises a powder funnel.

7. The reloading machine of claim 5, wherein:

said workstation tool comprises a powder measure assembly;

said first tool subassembly comprises a die mounted to said tool platform and defining said vertical bore;

said sleeve comprises a powder discharge tube of a powder body, wherein said power discharge tube is disposed at least partially within said vertical bore from the top end thereof;

said powder body further comprises a powder hopper and sliding powder bar, wherein the powder hopper is connected to feed powder into said sliding powder bar, and the sliding powder bar is configured to meter individual powder charges into the powder discharge tube in response to elevation of the powder body with respect to said die; and said first tool subassembly further comprises a generally upwardly extending bracket carrying said detection device to detect the elevation of the powder body.

8. The reloading machine of claim 5, wherein:

said workstation tool comprises a powder measure assembly;

said first tool subassembly comprises a die mounted to said tool platform and defining said vertical bore;

said sleeve comprises a powder funnel in a lower portion of the vertical bore and a powder discharge tube of a powder body, wherein said power discharge tube is disposed at least partially within said vertical bore from the top end thereof;

said powder body further comprises a powder hopper and sliding powder bar, wherein the powder hopper is connected to feed powder into said sliding powder bar, and the sliding powder bar is configured to meter individual powder charges into the powder discharge tube in response to elevation of the powder body with respect to said die; and said first tool subassembly further comprises a generally upwardly extending bracket carrying said detection device to detect the elevation of the powder body.

9. The reloading machine of claim 5, wherein:

said workstation tool comprises a powder level check assembly;

said first tool subassembly comprises a die mounted to said tool platform and defining said vertical bore; and said sleeve is disposed within said vertical bore and defines a central bore;

said first tool subassembly further comprises a generally upwardly extending bracket carrying said detection device to detect the elevation of the sleeve;

further comprising a central subassembly carried by said second tool subassembly for slidable motion in said central bore, wherein said second tool subassembly is sized and positioned to enter the open end of a shell case of the preselected caliber entering the vertical bore from said open lower end thereof to contact and be elevated in said sleeve by any powder charge in the shell case, whereby the central subassembly identifies a shell case with excess or deficient powder charge.

10. In a reloading machine configured to reload shell cases of a preselected caliber, an apparatus for checking the length of a shell case of said preselected caliber against a length specification for such preselected caliber, comprising:

a tool platform;

a housing connected to said tool platform and defining a substantially vertical bore with open lower end arranged for receiving a shell case from below the tool platform, wherein said vertical bore is sized to axially receive a shell case of said preselected caliber with sidewall clearance;

a sleeve slidably mounted in the vertical bore for axial movement between a repose height and an elevated height with respect to the tool platform, wherein said sleeve is sized to abut a top end of a shell case of the preselected caliber axially entering the vertical bore with leading open end, whereby the shell case can axially elevate the sleeve with respect to the tool platform;

an elevator device positioned below the tool platform, carrying a shell case of the preselected caliber with open end facing the lower end of the sleeve and in axial alignment with the sleeve, movable between a distant position to a nearer position of predetermined distance from the tool platform, wherein with respect to said repose height of the sleeve, said predetermined distance is such that a shell case of length exceeding said specification will elevate the sleeve at least by the excess length;

a detection device arranged to sense the elevation of the sleeve and to send an output signal in response to sensing a predetermined elevation;

an alarm connected to said detection device to receive said output signal and to produce an alarm signal in response to the output signal.

11. The apparatus of claim 10, further comprising:

an adjustment device operatively connected to said detection device to adjust said predetermined elevation at which an output signal is sent.

12. The apparatus of claim 11, further comprising:

a bracket mounted on said housing and having said detection device mounted on said bracket at a position suitable to sense the elevation of said sleeve;

wherein said adjustment device is an elongated mounting slot for the detection device, allowing adjustment of detection device position with respect to the bracket.

13. The apparatus of claim 11, further comprising:

a bracket mounted on said housing and having said detection device mounted on said bracket at a position suitable to sense the elevation of said sleeve;

wherein said adjustment device is an elongated mounting slot for the bracket, allowing adjustment of bracket position with respect to the housing.

14. A reloading machine configured to reload shell cases of a size having a predetermined maximum length specification and to identifies shell cases of a length exceeding said specification, comprising:

a tool platform carrying a reloading tool formed of at least a first tool subassembly that is substantially stationary with respect to said tool platform and a second tool subassembly that is vertically raisable with respect to the tool platform from a repose height of predetermined distance above the tool platform;

means located below the tool platform for carrying a shell case with open end facing up in a position substantially vertically aligned with said second tool subassembly;

means for reciprocating said shell case carrier means between a distant position and a near position to the tool platform, wherein said near position is no greater than the predetermined length specification from the second tool subassembly at repose height, whereby a shell case of greater length than the predetermined length specification will vertically raise the second tool subassembly;

means for detecting vertical raising of the second tool subassembly and emitting an output signal in response; and means for emitting an alarm in response to said output signal;

whereby the reloading machine detects shell cases of length in excess of the predetermined maximum length specification and identifies such cases by issuing an alarm.

* * * * *